United States Patent [19]

Kluy et al.

[11] Patent Number: 5,023,668

[45] Date of Patent: Jun. 11, 1991

[54] METHOD AND APPARATUS FOR ADHESIVE TRANSFER

[75] Inventors: Dennis J. Kluy, Stillwater; Gregory L. Zwadlo, Ellsworth; John L. Marty, White Bear Lake; William V. Dower, St. Paul, all of Minn.

[73] Assignee: Minnesota Mining and Manufacturing, St. Paul, Minn.

[21] Appl. No.: 504,526

[22] Filed: Apr. 16, 1990

[51] Int. Cl.[5] ..... G03G 15/16; G03G 13/16

[52] U.S. Cl. ..... 355/281; 430/126

[58] Field of Search ..... 355/271, 277, 278, 279, 355/280, 281; 430/126

[56] References Cited

U.S. PATENT DOCUMENTS

| | | | |
|---|---|---|---|
| 4,066,802 | 1/1978 | Clemens | 430/47 |
| 4,110,029 | 8/1978 | Goshima et al. | 355/256 |
| 4,146,324 | 3/1979 | Komori et al. | 355/256 |
| 4,383,019 | 5/1983 | Simm | 430/45 |
| 4,640,605 | 2/1987 | Ariyama et al. | 355/327 |
| 4,682,881 | 7/1987 | Komatsubara et al. | 355/296 |
| 4,728,983 | 3/1988 | Zwadlo et al. | 346/160 |
| 4,728,987 | 3/1988 | Diola et al. | 355/245 |
| 4,754,294 | 6/1988 | Kato | 346/160 |
| 4,800,839 | 1/1989 | Ariyama et al. | 118/691 |
| 4,863,543 | 9/1989 | Shiozawa et al. | 156/235 |

FOREIGN PATENT DOCUMENTS

| | | |
|---|---|---|
| 63-14166 | 1/1988 | Japan . |
| 63-183455 | 7/1988 | Japan . |

*Primary Examiner*—Joan H. Pendegrass
*Attorney, Agent, or Firm*—Kinney & Lange

[57] ABSTRACT

An automated lamination system for transferring an image to a print medium includes a photoconductive drum bearing a toned image on an electrostatic outer surface thereof. A dual purpose, heated lamination roller is moved to a first lamination position adjacent the drum to define a first nip between the drum and roller. The first nip in part defines a path for an image transfer web, and forces a thermally activated adhesive layer on the web against the drum. The image on the drum surface is embedded in the heated and softened adhesive layer as the web is advanced under pressure through the first nip. The dual purpose roller is later moved to a second lamination position adjacent a second lamination roller, to define a second nip therebetween. The second nip is configured to receive an image transfer substrate in registry with the latent image embedded in the adhesive of the web. The substrate and web are advanced through the second nip under heat and pressure, which forces the substrate against the adhesive layer and causes the substrate to adhere to the adhesive. A separation roller assembly spaced from the second nip along the path separates the web from the substrate so that the image embedded in the adhesive layer is borne by the image transfer substrate. The substrate is further processed through an optional inline deglossing station, while the web is rewound to align the remaining adhesive thereon with the drum for the transfer of another image.

40 Claims, 13 Drawing Sheets

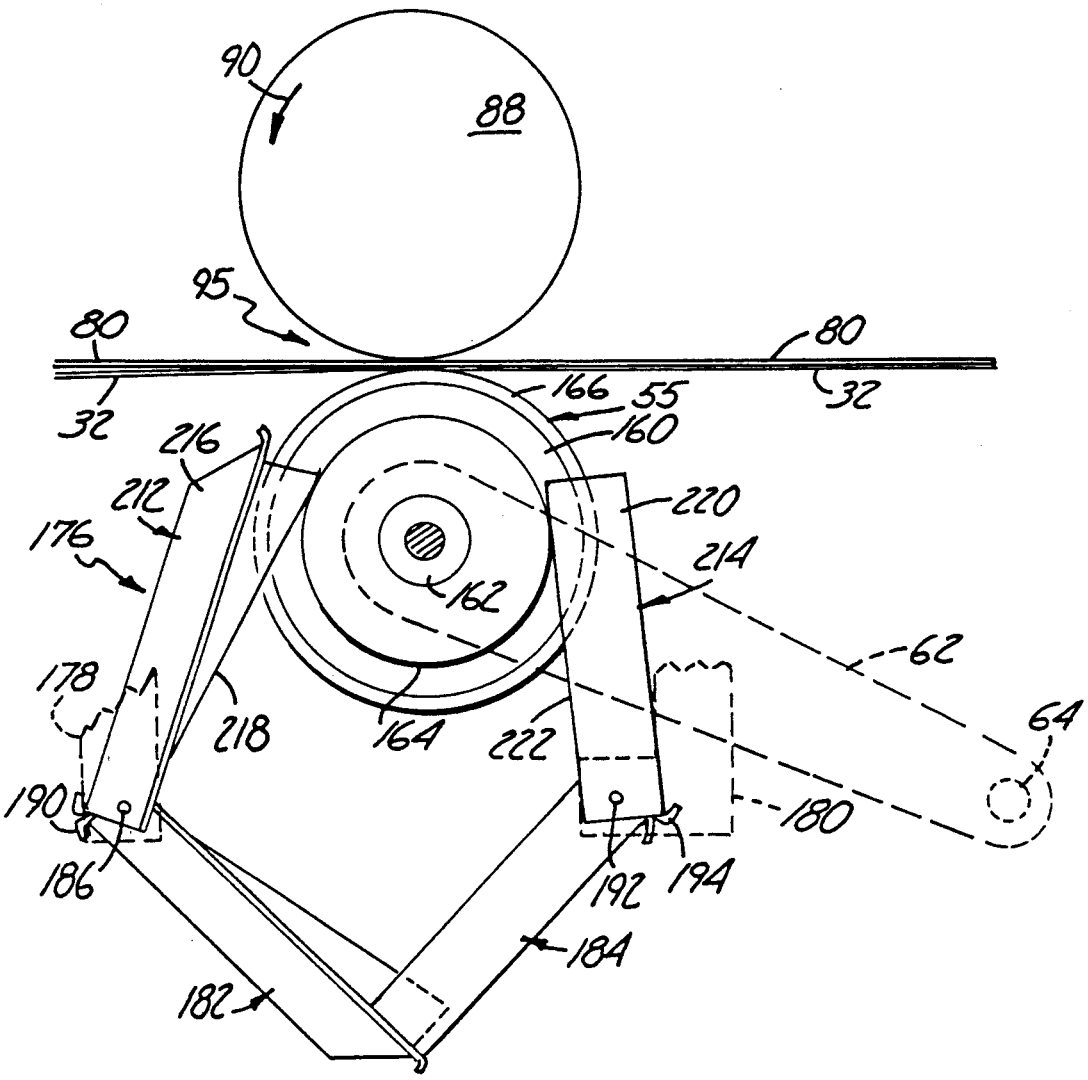
Fig. 11
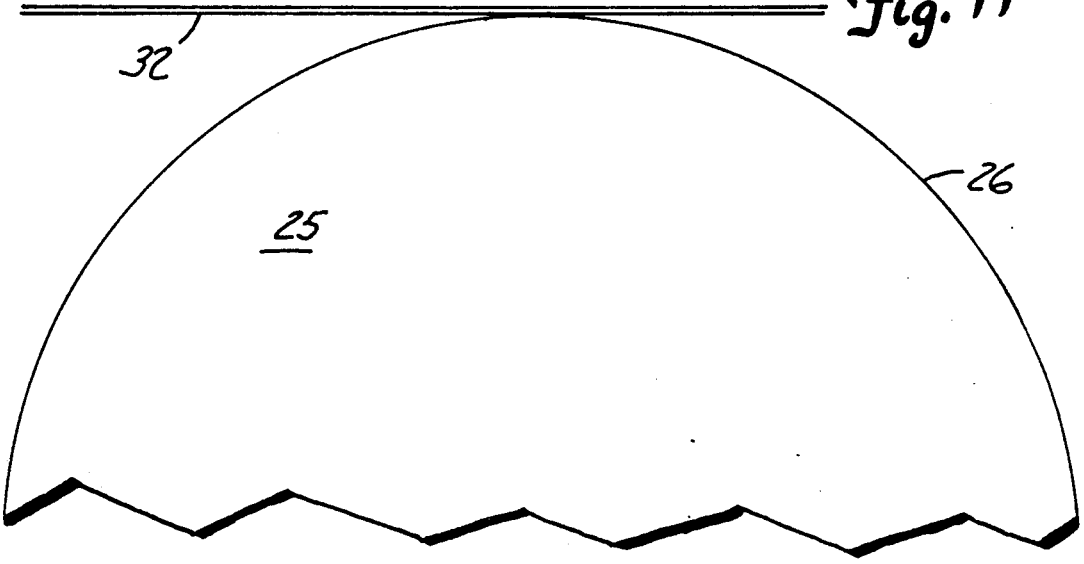

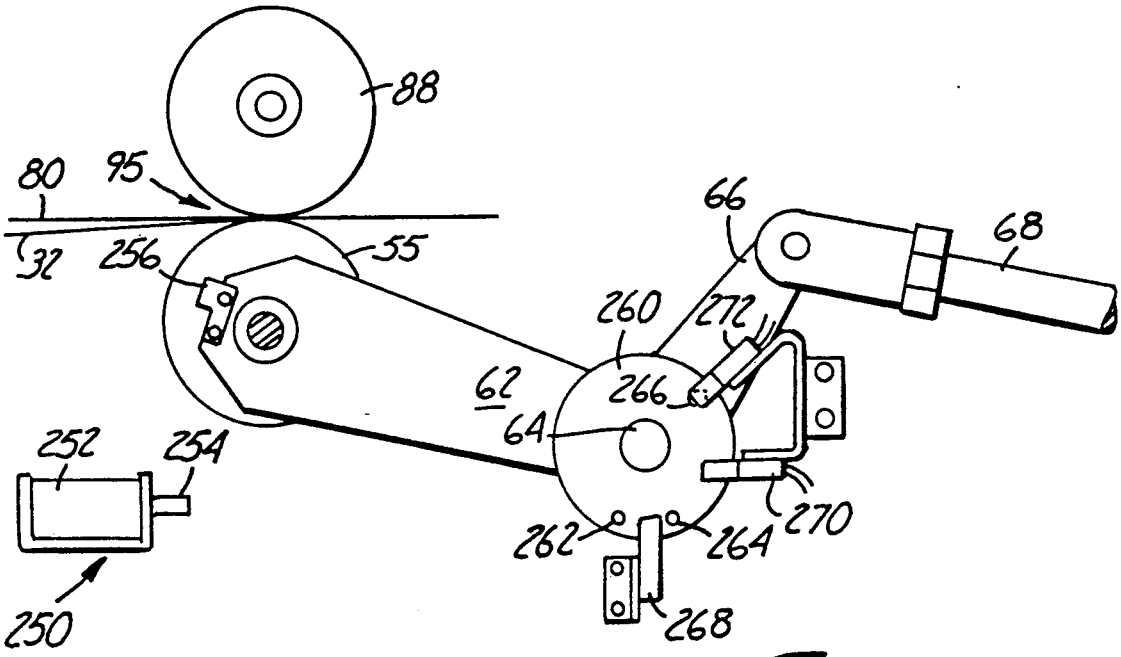
Fig. 14
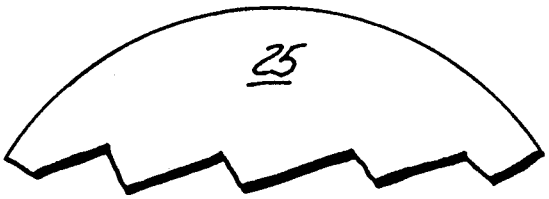

METHOD AND APPARATUS FOR ADHESIVE TRANSFER

BACKGROUND OF THE INVENTION

This invention pertains generally to multicolor electrographic printing devices. In particular, the present invention is an automated thermal lamination system for transferring a toned image from an electrostatic surface to a print medium.

Typically, to produce a multicolor print a photoconductive member of the electrographic printer is first charged to a uniform potential to sensitize its imaging surface. The charged surface of the photoconductive member is exposed to an image that is to be reproduced as a multicolor print. This procedure allows the photoconductive member to record an electrostatic latent image corresponding to the informational areas contained within the image.

To form a multicolor print, successive images are developed with different colored liquid toners supplied from corresponding toner developing modules. The color of the liquid toner in the particular developing module corresponds to the substractive primary of the color of the optical filter. Electrographic printing is normally done with yellow, cyan and magenta liquid toners. Usually the electrographic printer also includes a developing module having black liquid toner since it is required in virtually all commercial color printing applications. The different colored developed images are transferred from the photoconductive member to a print medium in superimposed registration with one another. A half tone screen is sometimes used to expose the images to create multisized dots that produce varying color tones needed to duplicate the original document. Heat is usually applied to permanently fuse the image to the print medium to form a completed multicolor print.

Numerous processes have been proposed for transferring an image from an electrostatic surface to a print medium. In some arrangements, the image is borne on a rotating drum and transferred directly to the print medium. Such an arrangement is illustrated, for example, in Ariyama et al. U.S. Pat. No. 4,640,605. In the process of this Ariyama et al. patent, a photosensitive drum serves as an image carrier. An optical system forms the electrostatic latent image on the drum, a development device develops the image into a visible image on the drum and a sheet feeder feeds an image transfer sheet between the drum and a charger for transferring the visible image from the drum to the image transfer sheet. The sheet is then separated from the drum and the photosensitive drum surface is cleaned for reuse.

Clemens U.S. Pat. No. 4,066,802 discloses the transfer of a multicolored toned image from a photoconductor, first to an adhesive carrier sheet, and then to a receptor sheet. The second transfer step involves the application of heat and pressure with a "polymeric or plasticized sheet" between the image on the carrier sheet and the receptor sheet surface. A temporary composite multicolored image is produced on the drum by overlaying on the surface a succession of liquid toned images of differing colors produced by separate charging, exposing and toning procedures. The conductor surface is addressed with an optical image or a chart retaining surface addressed with electrical styli. To produced the desired electrostatic latent image to be transferred.

Simm U.S. Pat. No. 4,383,019 discloses a process for transferring an image to a print medium to form a multicolor print. In this process, color separation images in red, green and blue are projected onto the surfaces of three metal drums. The surface of each metal drum is coated with a photoconductor which records the corresponding charged image. The charged image obtained for each color separation is continuously copied onto an image carrier which is moved past the drums. Immediately after the transfer of each image from a drum, the recopied charged image is transported by the continuously moving image carrier past a respective development apparatus wherein the charged images are developed in complimentary colors. The final fullcolor image is thus obtained by applying the partial charged images from each drum above one another on the image carrier, in correct registration. The image carrier is taken from a supply roll and transported mechanically over the metal drums. After the final color image has been applied on the image carrier, the image carrier travels with the image through a drying station. In a nip formed between a carrier drive drum and an idler drum, the transparent image carrier is backed with a white support layer and the toned image is fixed in the interface between the carrier and the support layer. The material used for the support layer is a self-adhesive white paper board which is taken from a continuous roll and pressed to the image carrier by an adhesive layer on the support layer. Before the support layer is applied to the carrier, however, a protective film covering the adhesive layer on the support layer is removed to expose the adhesive layer.

There is a continuing need for a process for efficiently and reliably transferring an image from an electrostatic member to a print medium. Current electrographic print arrangements are not reliable in their alignment of the transfer medium with respect to the carrier for the image, and often require special handling techniques or produce an end product which is aesthetically undesirable and requires further processing. In addition, prior electrographic printers have not been as efficient and compact as desired, nor have such printers been versatile enough to provide an end product which is suitable for all preprinting purposes. There is a continuing need for image transfer processes that can produce colorfast and smudge-free multicolor prints on a variety of proof paper substrates in a continuous and automated manner.

SUMMARY OF THE INVENTION

The present invention is directed to a method and apparatus for transferring an image in an electrographic copying apparatus. The method includes rotating a drum (which has a electrostatic outer surface bearing a toned image thereon) about its axis and providing a first lamination roller along an axis parallel to the axis of the drum and adjacent the drum to define a first nip therebetween. An image transfer web having an adhesive layer on one side thereof is advanced through the first nip to force the adhesive layer against the outer surface of the drum and thereby embed the toned image in the adhesive layer and transfer the image from the drum to the web as the web is advanced past the rotating drum. An image substrate is then aligned in a desired registry with the image borne by the adhesive layer on the web, and the substrate and web are advanced through a second nip defined by a pair of lamination rollers to force the substrate against the adhesive layer on the web and thereby adhere the substrate to the adhesive layer and embedded image on the web. The web is then separated from the adhesive layer and substrate, with the image embedded in the adhesive layer now borne by the substrate.

Preferably, the image transfer web has on one side thereof a first leading section bearing an adhesive layer thereon and a second trailing section bearing no adhesive. These sections are separated along a generally lateral separation line and the first section has a first segment of the adhesive layer which has a leading edge longitudinally spaced from the separation line, and a trailing edge defining the generally lateral separation line between the first and second sections of the web. For image transfer, the web is advanced longitudinally in a first direction along a web path to a position whereby the leading edge of the first section is aligned with a lead end of the toned latent image to be transferred to the web. The image and the first segment of the first leading section of the web are laminated together to embed the image in the adhesive layer on the first segment as the web is advanced along the path. The substrate is then laminated to the first segment of the first section of the web to bond the substrate and adhesive layer together as the web is advanced along the path. The web is then separated from the substrate, first segment of the adhesive layer and image embedded therein as the web is advanced along the path, with the separation of the leading edge of the first segment from the web defining a trailing edge of a second segment of the adhesive layer on the first leading section of the web. The newly defined trailing edge of the second segment in turn defines a new generally lateral separation line between the first and second sections of the web. After separation is completed, the web is then moved in a second, opposite direction along the path to a position whereby a leading edge of the second segment, which is longitudinally spaced from the trailing edge thereof, is aligned with a lead end of a second toned image to be transferred to the web.

BRIEF DESCRIPTION OF THE DRAWINGS

FIGS. 9–11 illustrate the operation of the dual purpose lamination roller of the image transfer system of the present invention, and its thermal insulating compartment.

FIGS. 12–14 illustrate the positioning arrangement for the dual purpose lamination roller of the image transfer system of the present invention.

While the above-identified drawing figures set forth one preferred embodiment, other embodiments of the present invention are also contemplated, as noted in the discussion. In all cases, this disclosure presents illustrated embodiments of the present invention by way of representation and not limitation. It should be understood that numerous other modifications and embodiments can be devised by those skilled in the art which will fall with the scope and spirit of the principles of this invention. In addition, the use of such relational terms as left/right, upper/lower, in/out, horizontal/vertical, etc. are used herein for reference purposes only and are not intended to be limiting features of the invention disclosed.

DETAILED DESCRIPTION OF THE PREFERRED EMBODIMENTS

System Overview

The present invention provides a method and assembly for making high quality multicolored prints by electrography, and is particularly suitable to color proofing applications. The present invention is particularly designed for use in digital data proofing used in combination with electrographic technology, which relies on liquid ink to provide the same characteristics and properties as ink-on-paper printing. A proof should be an exact duplicate of the ultimate printed sheet, looking like ink-on-paper and printed on the same paper as the final print job. A proof should be available immediately, obtainable from a user-friendly system and should be made up of variable-size dots, just like the printed sheet. Press proofs are one means for obtaining such a proof, but they have drawbacks and they are very costly. In addition, press proofs are almost never made on the same press that is used to print the final printing job. In addition, because there is no electronic control on a press for a dot gain consistency, virtually every sheet is a new original.

Electrographic technology, using liquid toner, provides a much higher resolution than dry toner systems and can duplicate the ink-on-paper prints desired for an effective proofing system. The present invention consists of a method and apparatus for transferring an electrostatic toned image to the final print medium in an electrographic copying device which employs direct digital color proofing techniques and liquid toner technology. The invention finds special utility in a wide range of applications, such as color proofing for the printing industry, colored map making and colored overhead transparencies. Its use is not limited to liquid toner applications, however, and it is contemplated that the invention be used in connection with toner powder image forming technology as well.

System Components

Figure 1:
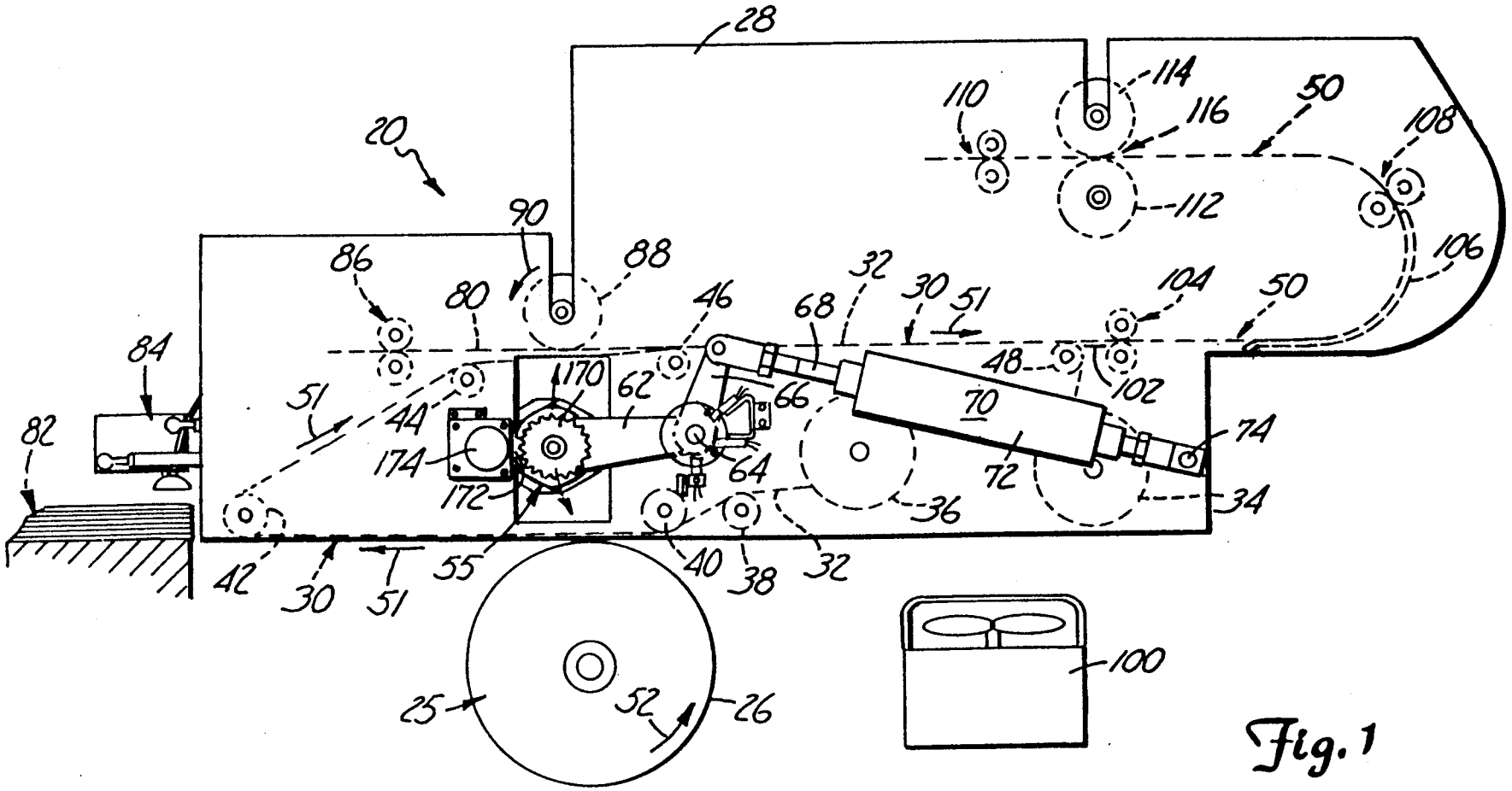
FIG. 1 is a side elevational view of an image transfer system for an electrographic copying device which includes present invention.

FIG. 1 illustrates the general components of the image transfer system 20 of the present invention. An image carrier such as a drum 25 has a electrostatic outer surface 26. Typically, a layer of photoconductor material coated on a plastic substrate having an electrically conductive surface layer is wrapped around the drum 25, fixed firmly to it and grounded. The outer surface 26 of the drum 25 thus provides a suitable carrier for an electrostatic latent image. Colored liquid toner is applied to the latent image to form a toned image suitable for transfer from the drum 25.

As seen in FIG. 1, the image transfer system 20 of the present invention is aligned generally over the drum 25. The system components are supported primarily by a frame 28 of the electrographic device, which is shown in part, and which also supports the drum 25 for rotation about its axis. An image transfer path 30 is defined in part by an intermediate image transfer web 32. The web extends from a web supply reel 34 to a web take-up reel 36, both of which are rotatably supported by the frame 28. In FIG. 1, the path 30, web 32 and reels 34 and 36 are illustrated in phantom. A plurality of guide rollers are also provided to support and guide the web 32 along the path 30, such as guide rollers 38, 40, 42, 44, 46 and 48 (also illustrated in phantom in FIG. 1). Guide rollers 38 and 40 act to apply back-tension to the web 32 as it is advanced along the path 30, as do the supply and take-up reels 34 and 36.

The image transfer web 32 has a multilayer structure comprising in sequence, a base layer, a transferable release layer and a releasable adhesive layer (releasable from the base layer along with the transferable release layer so that both layers transfer at once). In a preferred embodiment of the web, the base layer is formed from a 2 mil. polyester (PET) film. The transferable release layer is placed on one side of the base layer by a coating solution of 55.8% Methanol, 137.2% n-Propanol solvent and a transparent 7.0% Butvar B-73 (polyvinyl butyryl) resin (percentages by weight). This coating solution is placed on the base layer and dried to remove the solvents. A coating weight range of 0.5 to 5 $g/m^2$ is desirable, with a preferred coating weight of 3 $g/m^2$. Higher coating weights are more flexible. The choice of polymer and the coating weight used for the adhesive layer will influence the desired weight of the release layer. With respect to the adhesive layer, a coating solution of 70% methyl ethyl ketone, 18.9% EPON 1007 resin and 11.1% EPON 828 resin (percentages by weight) is laid on top of the release layer and dried to remove the solvent. The adhesive layer is coated on the film layer to a coating weight of 1.6 to 21.6 $g/m^2$. In a preferred embodiment, the adhesive layer dry coating weight is 15 $g/m^2$. Lower coating weights have greater flexibility but poor adhesion to rough surfaces. The adhesive layer is transparent and formed as a thermally activated epoxy adhesive. In use, the adhesive layer of the web 32 is contacted with the image bearing surface 26 of the drum 25 to pick up the toned image thereon. The adhesive layer must thus be releasable from the surface 26, while maintaining its adherence to the web under heat and pressure, and should adhere to the toned image under heat and pressure without disturbing the image. The adhesive layer must have appropriate thickness and flow properties under the desired heat and pressure conditions to allow the adhesive to flow over and around the toned image so as to assure its adherence to the adhesive layer. The thickness of both the release layer and adhesive layer are functions of the desired dot gain and substrate proof paper to be used.

In use, an image is transferred from the drum 25 onto the web 32 and follows a processing path through the electrographic copying apparatus which is in part defined by the web path 30, and which also includes a substrate processing path 50. As an image is moved through the electrographic copying device from the drum 25, it first moves along the path 30 and then along the path 50. As it is moved along these paths (in a first longitudinal path direction as indicated by arrows 51), it passes through various operation stations for image transfer and processing. As it is moved along the path 30, the image is carried by the web 32. The web 32 defines the path 30, and during the time it is carrying an image, moves from its take-up reel 36 back to its supply reel 34 (generally "clockwise" along the path 30, as viewed in FIG. 1). The components which comprise each image processing station are identified below, and then the operational sequence of the image transfer system 20 of the present invention is described.

At a first image transfer station, the drum 25 extends laterally across the path 30 with its electrostatic outer surface 26 adjacent the web 32. The drum 25 is rotated counterclockwise as viewed in FIGS. 1 and 2 for image transfer (in direction of arrow 52). A dual purpose lamination roller 55 also extends laterally relative to the path 30 and is positioned above the drum 25, with the web 32 therebetween. This dual purpose lamination roller 55 is movable down to a first lamination position adjacent the drum 25 (see FIG. 2) to define a first lamination nip 60 laterally across the path 30 and thereby press the web 32 against the outer surface 26 of the drum 25. The lamination roller 55 is heated for activation of the thermal adhesive layer and rotates freely when in its first lamination position to act as an idler roller, free to follow the movement of the web 32 and rotating drum 25.

The first lamination roller 55 is mounted on a lever arm 62 which in turn is pivotally mounted to the frame 28 as at pivot point 64. The lever arm is driven to pivot up and down through a linkage 66 which is connected to a ram 68 of a pneumatic actuator 70, which has its cylinder 72 in turn pivotally connected to the frame 28 as at pivot point 74.

As the web 32 passes longitudinally along path 30 over the drum 25, the adhesive layer side of the web 32 is on the drum side of the web 32. The drum 25 is driven at a desired speed to accomplish image transfer and the web 32, being in engagement with the drum 25 under a desired pressure from the first lamination roller 55, is drawn into the through the nip 60 in the first direction 51. Take-up reel 36 and tension rollers 38 and 40 place back tension on the web 32 as it is advanced along the path 30 and through the nip 60.

A substrate pick-up station is positioned in the image transfer system 20 generally above the drum 25 and first lamination roller 55. At this station, a substrate for supporting the final proof product is laminated to the web 32. A substrate sheet, indicated generally by sheet 80, is picked up from a supply of substrate sheets 82 by a suitable sheet pick-up and transfer mechanism 84 (see FIG. 1). The substrate 80 is fed by the mechanism 84 into a pair of substrate guide and drive rollers 86 which position the substrate 80 for lamination to the web 32. A second lamination roller 88 is mounted with respect to the frame 28 to extend laterally across the path 30. The second lamination roller 88 is driven to rotate counterclockwise for lamination (in direction of arrow 90 in FIG. 1). The first lamination roller 55 is moved to a second lamination position adjacent the second lamination roller 88 to define a second nip 95 (see FIG. 5) across the path 30 for pressing the web 32 against the substrate 80 and driven second lamination roller 88. The driven roller 88 is rotated at a desired speed to accomplish a lamination of the substrate 80 to the web 32 as it is advanced along the path from its take-up reel 36 to its supply reel 34 (in direction of arrow 51). At the substrate pick-up station, the adhesive layer on the web 32 faces the second lamination roller 88 so that the substrate 80 is pressed against the adhesive layer as it passes through the nip 95. The first lamination roller 55 is heated, as mentioned above, to activate the thermal adhesive layer thereon, and rotates freely when in its second lamination position to act as an idler roller free to follow the movement of web 32 and rotating second lamination roller 88. The take-up reel 36 and tension rollers 38 and 40 continue to place back tension on the web 32 as it is advanced, and the roller 86 place back tension on the substrate 80 as it is drawn into and through the nip 95.

As the web 32 and substrate 80 now laminated thereto are further advanced along the path 30, the thermally activated adhesive therebetween is cooled by means of a cooling fan 100 which is directed to push air against and around the web 32. This allows the adhesive to set about the image and also to adhere firmly to the substrate 80.

Guide roller 48 defines, in part, a web/substrate separation station wherein the substrate is peeled away from the web 32. As seen in FIG. 1, the path 30 is generally linear from the substrate pick-up station forward along the path (in the first direction 51). The substrate 80 continues in a generally linear path past the guide roller 48 over a separation guide plate 102 and through a pair of substrate guide and drive rollers 104. After the web 32 passes over the guide roller 48, however, it is directed abruptly away from the linear path followed by the substrate 80 and toward its supply reel 34. This abrupt change in direction of the web 32 as opposed to the continued linear movement of the substrate 80 allows a clean separation of the cooled adhesive layer from the web 32. The adhesive layer remains adhered to the substrate 80, and the image entrained by the adhesive layer and substrate 80 thus continues to move along the substrate processing path 50.

The substrate 80 is driven and guided along path 50 by driven guide rollers 104, curved guide plate 106, and additional driven guide rollers 108 and 110. As borne by the substrate 80, the image is useful and has a protective coating of the adhesive layer and release layer thereon. The substrate 80 may be further processed without affecting the substantive aspects of the image itself. For example, the surface reflectance of the image surface might be altered. Without further processing, the image surface is quite glossy. For some proofing applications, it may be desired that the image surface be "deglossed"60 or otherwise processed to achieve desired surface characteristics. As seen in FIG. 1, the substrate 80 is guided through an image "deglossing" station which is comprised of a pair of in-line deglossing rollers 112 and 114 which combine to define an deglossing nip 116 across the path 50. One of the deglossing rollers is heated and one of the deglossing rollers is driven at a rate comparable to the driven rate of longitudinal movement of the substrate 80 along the path 50. The final gloss or texture appearance of the image proof print on the substrate 80 is controllable by means of the deglossing rollers 112 and 114, as a function of the temperature of the heated deglossing roller, the pressure applied between the deglossing rollers and the speed at which the substrate 80 is passed through the nip 116 therebetween. The rollers 112 and 114 are selectively separable as well, if no deglossing processing is desired for a particular image.

Figure 2:
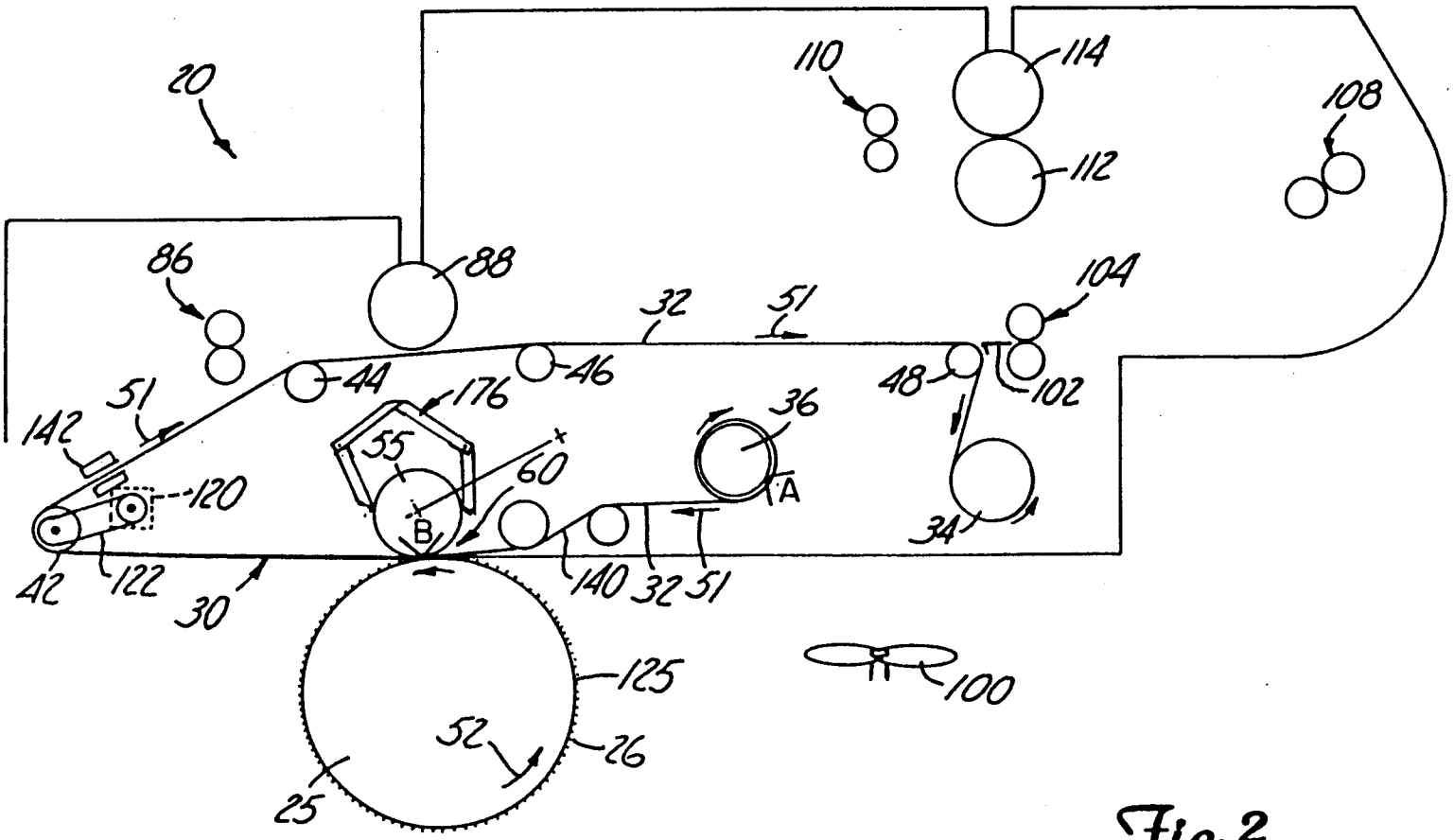
FIGS. 2–8 are diagrammatic illustrations of the image transfer system of the present invention, showing the sequence of operation for transferring an image from an image carrier to a substrate.

Suitable conventional drive arrangements are provided for the various rollers of the image transfer system 20. The speeds of the driven reels, rollers and other system mechanisms are coordinated for smooth and efficient movement of the web 32 and substrate 80 along the paths 30 and 50. The operations and functions of the electrographic copying device are automated or controlled by a microprocessor controller. As seen in FIG. 2, a rotary encoder 120 is connected to the guide roller 42 by suitable means, such as an endless belt 122, to track the extent and speed of web movement along the path 30 and provide a signal of relative web position (and, therefore, image position) to the microprocessor controller.

System Sequential Operation (FIGS. 2–8)

The image transfer system 20 of the present invention is used once a toned image has been placed by liquid toner on the electrostatic outer surface 26 of the drum 25. In FIGS. 2–7 a first image 125 is shown, While in FIGS. 7 and 8, a second image 125' is shown. Both images are illustrated in the drawing FIGS. 2–8 by a series of dots applied either to the drum 25, web 32 or substrate 80.

To transfer the image 125 from the drum 25 to the web 32, the dual purpose lamination roller 55 is moved to its first lamination position, as seen in FIG. 2, thereby defining nip 60. The web 32 has a first leading section bearing the adhesive layer, and a second trailing section with no adhesive thereon. These two sections are separated by a generally lateral separation line which is indicated in FIGS. 2–6 as point A on the web 32. FIG. 2 illustrates the initiation of an image transfer process, with the portion of the web 32 bearing the lateral separation line of point A wound upon to the take-up reel 36. The first leading section of the web has a first segment 140 of the adhesive layer which has a leading edge longitudinally spaced along the web 32 from the separation line of point A. In FIGS. 2–8, this leading edge is indicated generally as at point B, a lateral line defined across the web 32. Thus, the first segment 140 is defined by that portion of the web 32 and adhesive layer thereon between points A and B on the web 32. Point B is defined as that line across the web 32 which first encounters the nip 60 when the first lamination roller 55 is lowered to press against the drum 25. Point B on the web 32 is aligned with a lead end of the image to be transferred from the drum 25.

To effectuate the transfer of image 125 onto the web 32, the drum 25 is rotated in direction of arrow 52. Since the web 32 is in contract with the drum 25 under pressure, it advances at the same speed in the first direction of arrows 51 in FIG. 2. As the web 32 passes through the nip 60 defined between the drum 25 and dual purpose lamination roller 55, the heated roller 55 softens the thermal adhesive and causes it to flow around the toned image on the drum 25 and thus embed the image in the adhesive and take it off of the drum 25 to be carried by the web 32 as it is advanced past the drum 25. Although the desired rate of drum rotation and web movement are variable, a suitable rate for image transfer is 15 linear inches per minute of longitudinal movement of the web 32, at a temperature range of 30° to 160° C. and at a pressure range of 0.1 to 50 kg/cm$^2$ across the nip 60. Sufficient heat and pressure are applied to enable the image to be adhered to the adhesive layer with greater strength than its adherence to the surface 26 of the drum 25. The web 32 is held under uniform tension by the tension guide rollers 38 and 40 and the resistive force of take-up reel 36. As the web 32 is advanced in the first longitudinal direction 51, the supply reel 34 acts as a web take-up reel removing slack from the web 32. Exact web position and corresponding image position is continuously monitored by the rotary encoder 120. Once the web 32 and drum 25 have moved a distance equal to the length of image 125 (e.g., equal to or less than the circumference of the drum 25), the dual purpose first lamination roller 55 is moved to its neutral position (see position of roller 55 in FIGS. 1 and 3) and lamination ceases as point A on the web 32 passes over the drum 25 (behind point A there is no adhesive on the web 32 to make an effective lamination).

A device for measuring transmitted or reflected light, such as a transmission densitometer is provided along the path 30 between the guide rollers 42 and 44. The first segment 140 of the adhesive layer on the web 32, with the image 125 now embedded therein, is advanced in the first direction 51 along the path 30 until its trailing edge (point A) is moved past the densitometer 142 (see FIG..3). The densitometer 142 scans the image 125 on the web 32 and evaluates the quality of the transferred image, and for example measures the light transmission density of a series of test patches of the image 125 on the web 32 (i.e., it measures the amount of light passing through selected portions of the image 125). This information is then provided to the microprocessor controller for use in modifying the factors used to develop the color toner image on the drum 25 for the next image 125' to be processed in the electrographic copying device. The densitometer 142 thus provides immediate electronic feedback for improving or modifying subsequent image quality.

Figure 3:
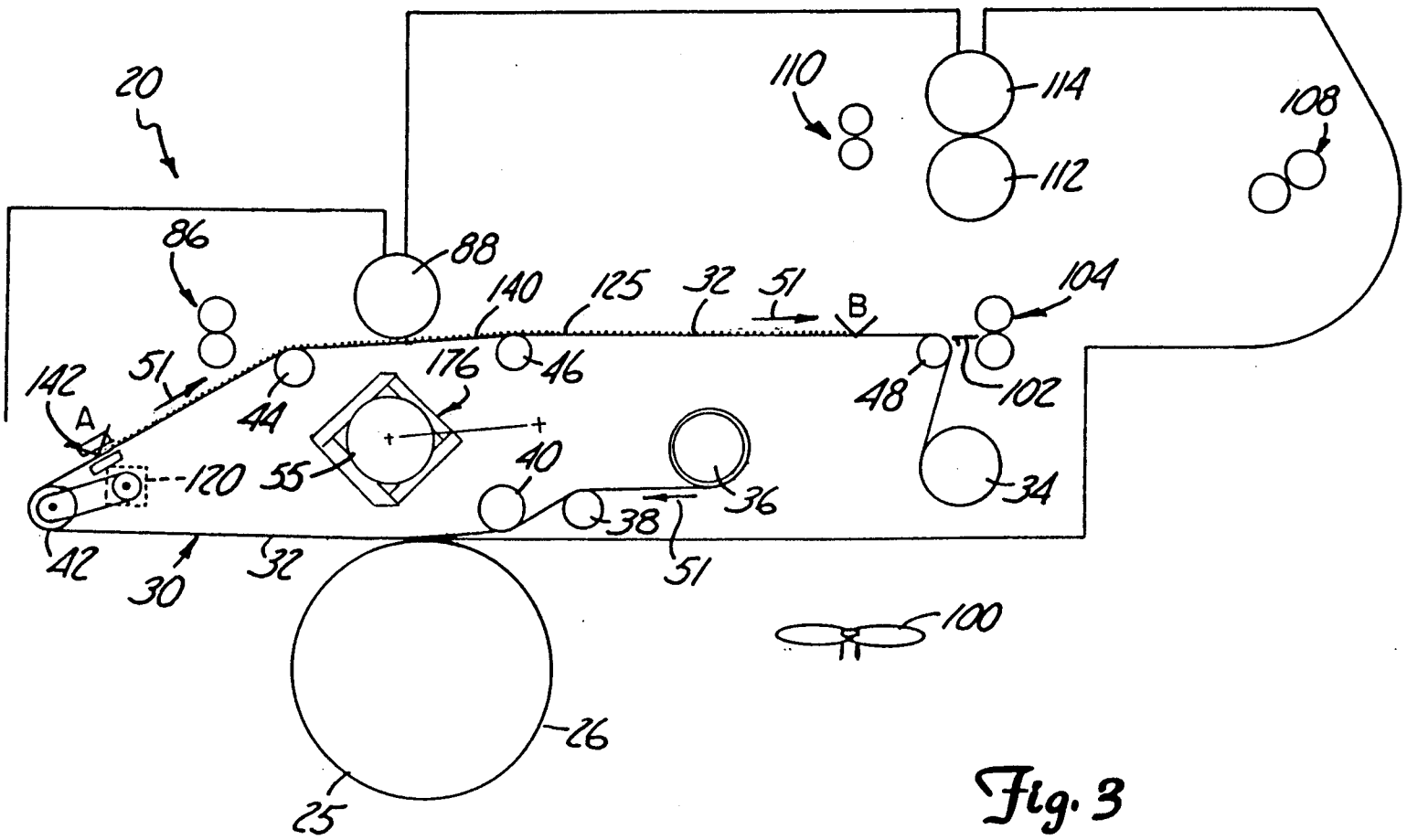
Figure 4:
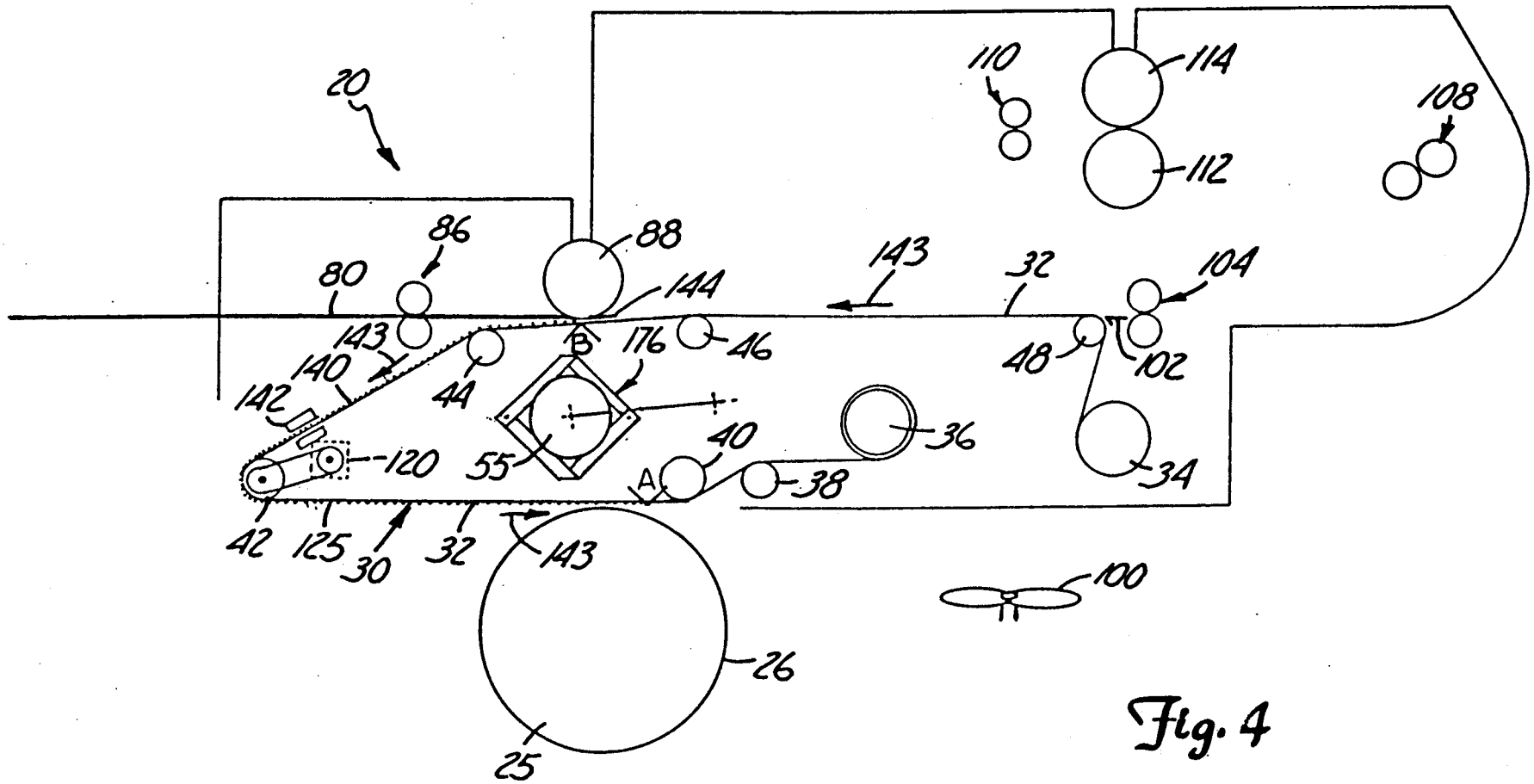

FIG. 3 illustrates the first segment 140 with the image 125 thereon in its position along the path 30 having been completely evaluated by the densitometer 142. At this point, the advance of the web 32 in the first direction 51 is stopped. The direction of web movement is then reversed along the path 30 to move in a second opposite direction (as indicated by arrows 143 in FIG. 4) so that the web 32 is moved toward the takeup reel 36. The web 32 is moved in the second direction 143 until the leading edge (point B) of the first segment 140 is aligned just proximal of the second lamination roller 88. A substrate 80 has been advanced by the substrate pick-up and transfer mechanism 84 and driven roller pair 86 to a lamination ready position as indicated in FIG. 4. The substrate 80 is preloaded into the area of the lamination nip 95 by moving a leading edge of the substrate 80 under and past the second lamination roller 88 to define a substrate leading edge portion 144. The leading edge of the substrate 80 is thus longitudinally spaced from the leading edge (point B) of the first segment 140 on the web 32.

Figure 5:
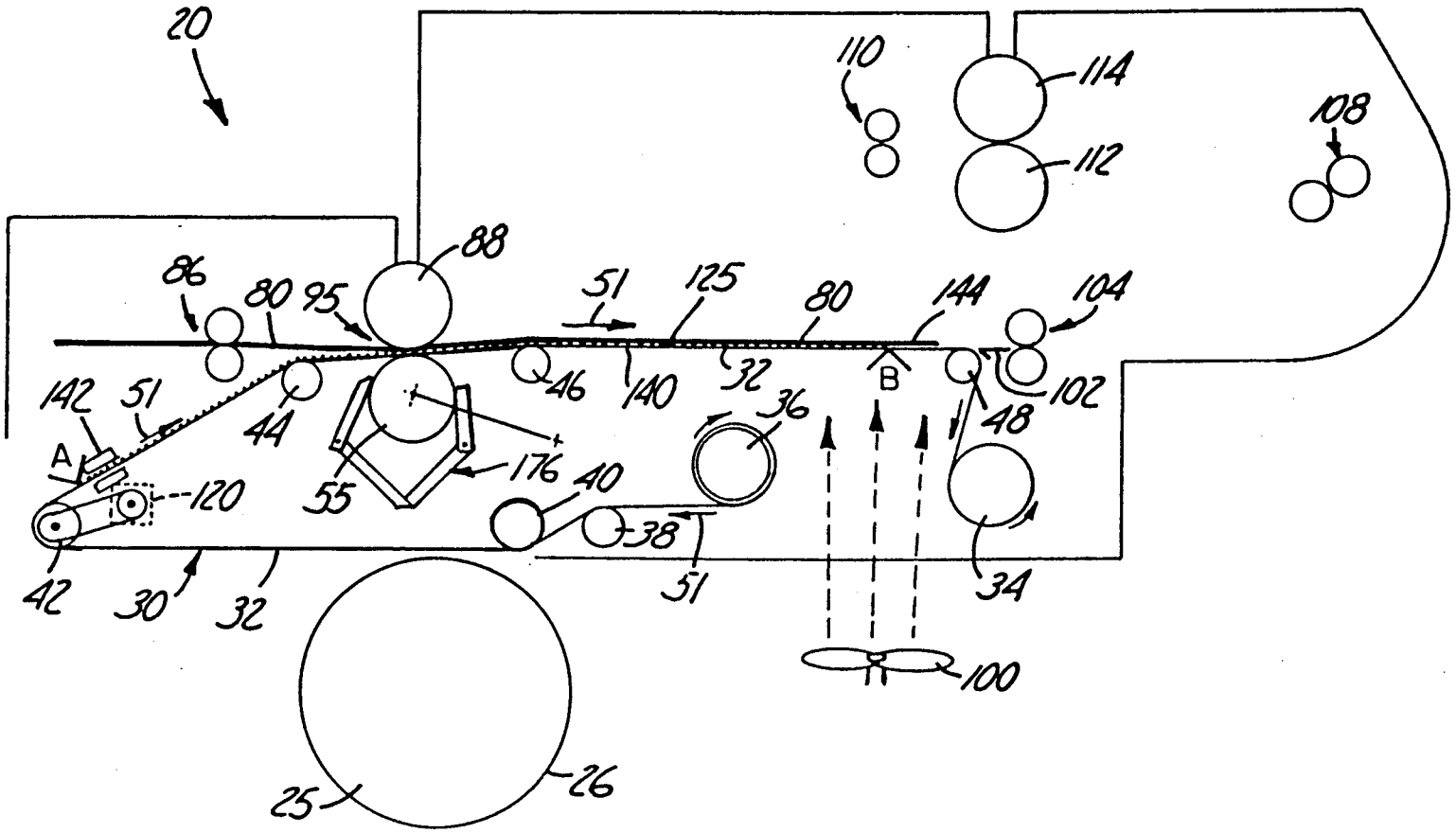

The first lamination roller 55 is then moved into its second lamination position to define the nip 95 between the first lamination roller 55 and the second lamination roller 88, as seen in FIG. 5. Once the nip 95 has been so defined, the second lamination roller 88 is driven to rotate in direction of arrow 90. Since the web 32 and substrate 80 are in contact with the driven roller 88 under pressure, they advance together at the same speed in the first direction 51 to laminate the substrate 80 to the web 32. The heated first lamination roller 55 again softens the adhesive on the web to adhere it under pressure to the substrate 80 as it passes through the pressure of lamination nip 95. The lead portion 144 of the substrate 80 is not laminated to the web 32, as indicated in FIG. 5, which shows the substrate 80 partially laminated to the image bearing first segment 140 of the web 32. A suitable rate for substrate lamination is 50 to 150 linear inches per minute of longitudinal movement of the web 32 and substrate 80 through the nip 95, with the same temperature and pressure ranges mentioned above across the nip 95. The web 32 is again held under uniform back tension by the tension guide rollers 38 and 40 and the resistive force of take-up reel 36, while the rollers 86 place back tension on the substrate 80. As the web 32 is advanced in the first longitudinal direction 51, the supply reel 34 again acts as a web take-up reel removing slack from the web 32. Web position and corresponding image position is continually monitored by the rotary encoder 120. When the encoder 120 detects that the web 32 has moved a sufficient distance so that the trailing edge of the first segment 140 (point A) is at the nip 95, the dual purpose first lamination roller 55 is then moved away from the second lamination roller 88 to end substrate lamination.

After passing through the nip 95, the now laminated web 32 and substrate 80 traverse a generally linear section of the path 30 between guide rollers 46 and 48. The adhesive layer, which still has the image 125 embedded therein, is cooled as this laminated assembly moves along the path 30 between guide rollers 46 and 48. This cooling is facilitated by the fan 100 blowing air against the web 32 from its side opposite the adhesive layer and laminated substrate 80. This cooling allows the adhesive to cure and set on the substrate 80 and about the embedded image 125.

Figure 6:
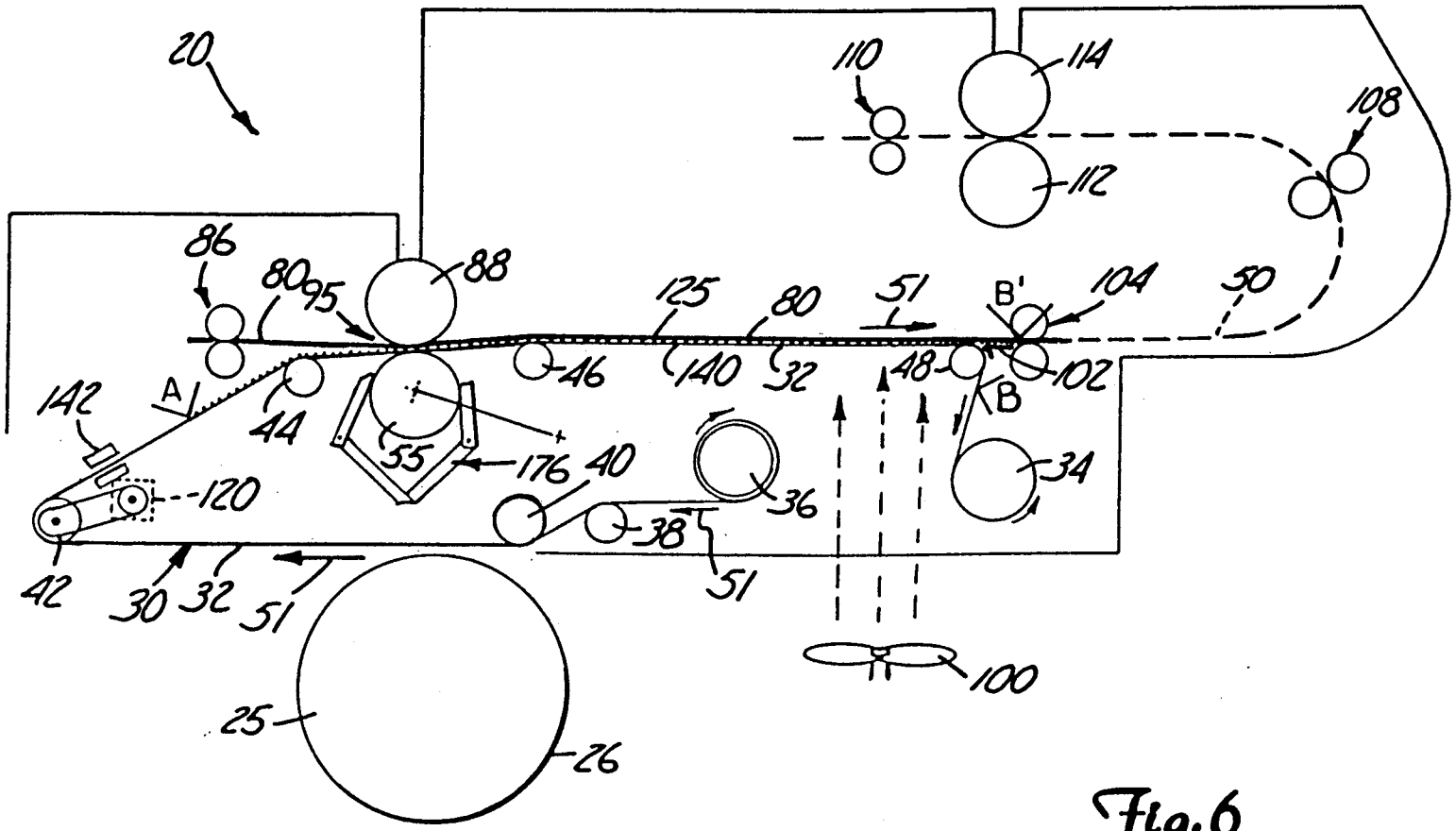

As the laminated substrate 80 and web 32 continue to advance along the path 30, the web passes over guide roller 48 and abruptly changes direction (downwardly as viewed in FIG. 6) to be wound onto its supply reel 34. The leading edge portion 144 of the substrate is prevented from following the web 32 around the guide roller 48 and downwardly by a guide plate 102 which engages the unlaminated portion 144 and maintains the substrate 80 in a generally linear path over the guide plate 102 and into a pair of driven substrate guide rollers 104. The sudden change in direction of the web 32 relative to the substrate 80 causes the cooled adhesive to separate from the web 3 (as provided for by the release layer between the adhesiVe layer and the polyester web 32), at point B on the web 32. A clean separation line or "fracture" of processed adhesive staying with the substrate 80 and unprocessed adhesive staying on the web 32 is created laterally across the web 32 at point B. The adhesive from the first segment 140, with the image 125 embedded therein, thus remains adhered to the substrate 80 as it is separated from the web 32 and continues along the substrate guide path 50 as initially defined by the guide plate 102 and driven guide rollers 104. As indicated in FIG. 6, this separation may take place even before the entire image 125 has been transferred from the first segment 140 of the web 32 onto all portions of the substrate 80 (i.e., the trailing edge (point A) of the first segment 140 has not yet passed through the nip 95 with its respective portion of the substrate 80). The release layer is also transferred from the web 32 to the substrate 80 and provides a clear tough and scratch resistant coating over the image 125 borne thereon.

The substrate 80 continues to be driven and guided along the substrate path 50 until complete separation between the web 32 and substrate 80 is achieved. Thus, as the trailing edge (point A) of the first segment 140 of the web 32 passes over the guide roller 48, it represents the end of the laminated assembly of web 32 and substrate 80, and also the new end of the adhesive layer now remaining on the first section of the web 32 (the first segment 140 of the web 32 has no adhesive remaining on it between points A and B, and there is no adhesive on the web 32 between point A and the take-up reel 36). There is adhesive on the web 32, however, between point B and the remaining portions of the web 32 extending to and onto the web supply reel 34.

The unique image transfer system 20 of the present invention provides a separation arrangement between the substrate 80 and web 32 such that the separation of the adhesive layer from the web 32 is quite clean and precise, and creates a generally lateral separation line at point B. The laminated portion of the adhesive layer continues on with the substrate 80 along the substrate path 50 for further processing, while the unlaminated portion of the adhesive layer stays on the web 32. The separation line now defined at point B separates the now-reduced first section of the web (bearing adhesive) from the now-enlarged second section of the web (without adhesive), with the amount of reduction/enlargement of the second section corresponding to the size of the first segment 140.

Figure 7:
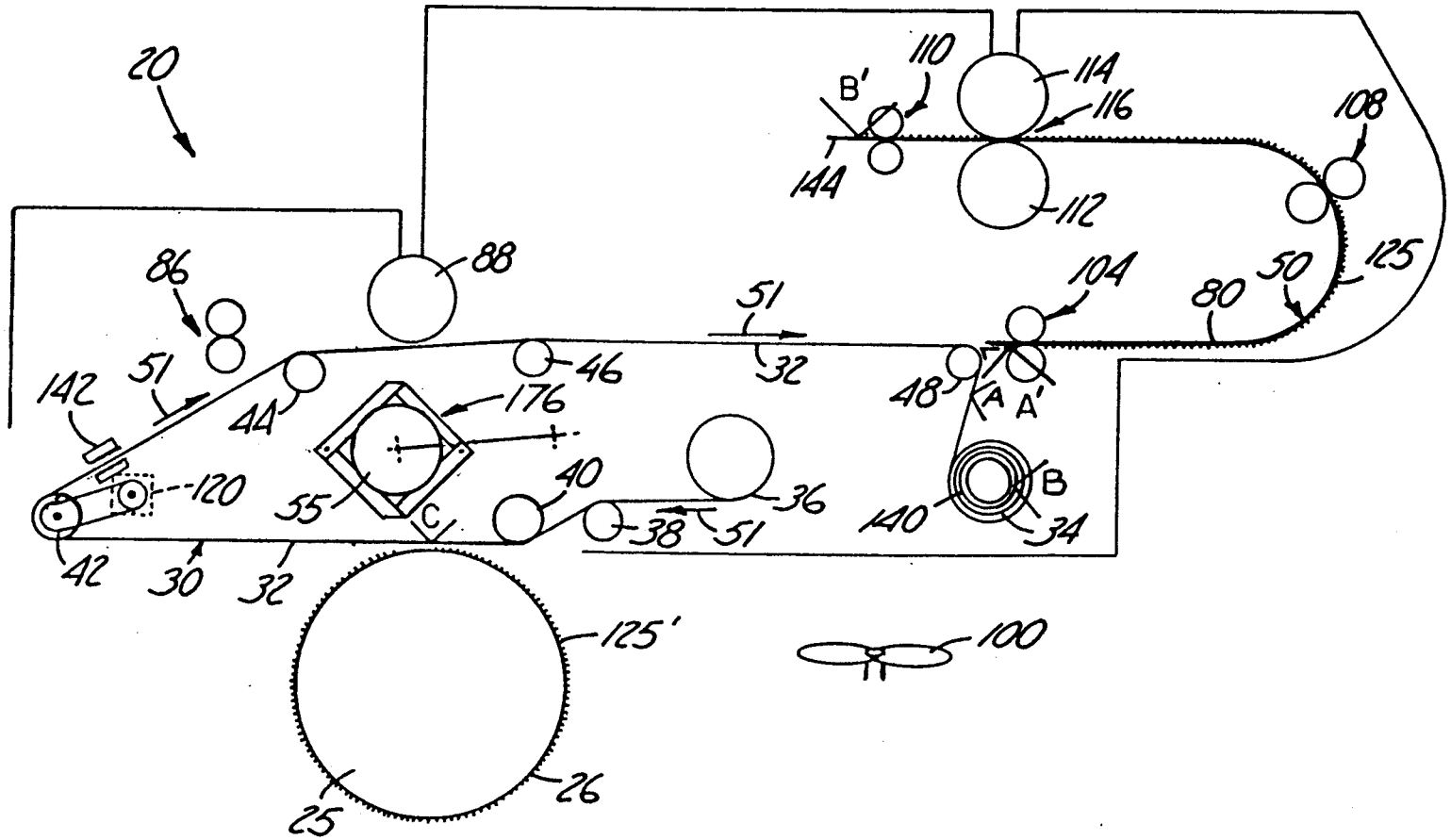
Figure 8:
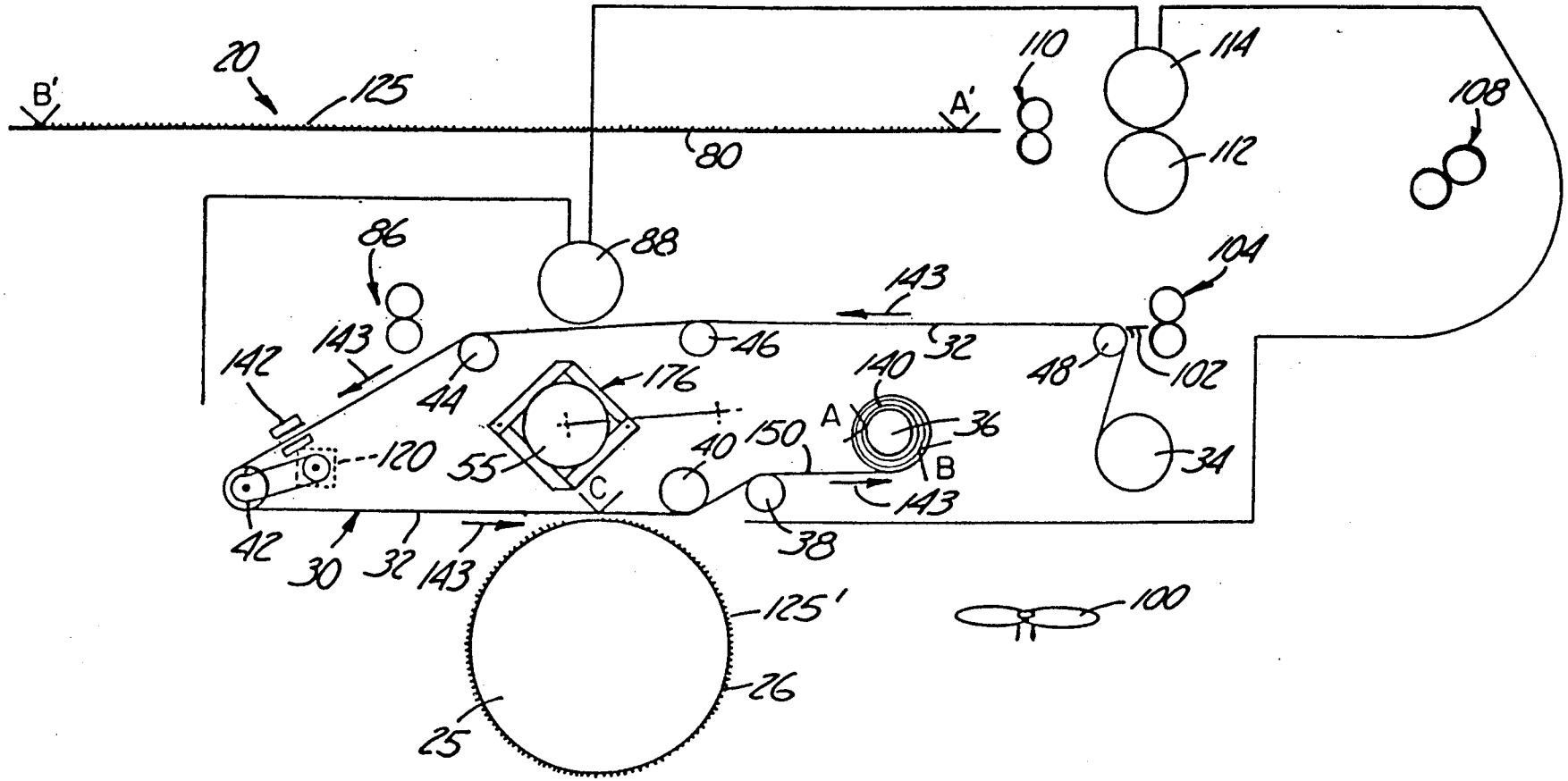

In FIGS. 7 and 8, the lead and trailing edges of the image 125 on the substrate 80 are indicated as point B' and point A', respectively. In FIG. 7, the first segment 140 of the web 32 is shown as at least partially wound onto the web take-up reel 34, and once it reaches this position web advance in the first direction 51 is stopped. At the same time, the substrate 80 is guided into the nip 116 between the deglossing rollers 112 and 114 for further processing (if desired) to develop the desired gloss or surface texture on the image 125 borne by the substrate 80. Once the substrate 80 has fully passed between the deglossing rollers 112 and 114, and final guide rollers 110, the image 125 borne thereon has been fully processed by the electrographic copying device and can be removed therefrom for viewing (e.g., see FIG. 8).

As the substrate 80 and image 125 thereon pass through the deglossing rollers 112 and 114, the web 32 is moved in the second direction 143 along the path 30 toward take-up reel 36 for use in proCessing a next toned image 125'. The web 32 is moved to an extent illustrated in FIG. 8 wherein the first segment 140 is wound onto supply reel 36 and a second segment 150 is positioned with its lead edge (indicated as at point C in FIG. 8) aligned with a lead end of the next image 125' to be transferred from the drum 25 to the web 32. The relative position of the web 32 throughout this realignment process (and throughout the entire process) is monitored by the encoder 120 operably connected to the driven guide roller 42. The trailing edge of the second segment 150 is at point B on the web, along that lateral separation line where the adhesive layer now ends on the web 32.

When aligned as shown in FIG. 8, the web first adhesive-bearing section of the 32 extends from its supply reel 34 to point B, which is partially wound onto the take-up reel 36 (to the same extent that point A was partially wound on the take-up reel 36 in FIG. 2). The second segment 150 thus represents that portion of the adhesive layer and web 32 between points B and C, and corresponds to the relative length of the second image 125' to be transferred from the drum 25 to the web 32.

Once the second segment 150 and its lead edge (point C) have been aligned with second image 125' to be transferred, the image transfer process is accomplished for the second image 125' in the same manner as described above with respect to the first image 125. This sequential operation can then be continually repeated for each successive segment of the adhesive layer until the first adhesive-bearing section of the web is completely used up and a new web must be provided with a fresh adhesive layer. The adhesive layer is thus used sequentially, with a segment being laminated to an image and then separated with the image from the web by each cycle of the image transfer process. The image transfer system 20 described herein can be used in any electrographic copying system where it is desirable to offset an image from an electrostatic surface onto a variety of substrate materials.

Dual Purpose Lamination Roller

Figure 9:
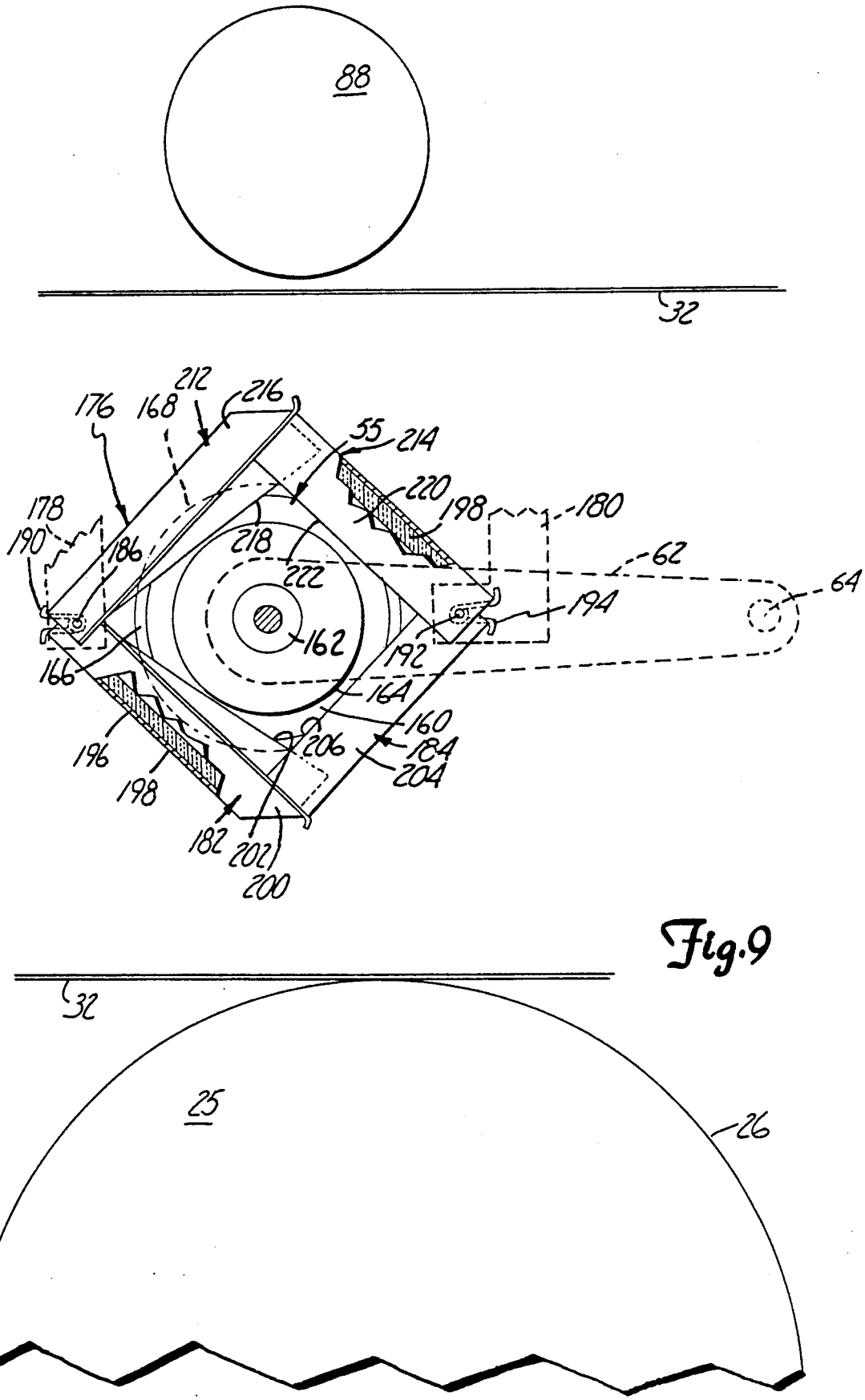

As seen in FIGS. 1, 3, 4, 7, 8 and 9, the dual purpose first lamination roller 55 has a third position intermediate between its first and second lamination positions. In this third position, the first lamination roller 55 is spaced from both the drum 25 and second lamination roller 88 and is thus in a non-laminating state. As best seen in FIG. 9, the first lamination roller is formed from an aluminum cylindrical member 160 which has an axial heating element 162 extending therethrough. At each end of the cylindrical member 160, a reduced diameter hub 164 is provided. On the larger diameter cylindrical member 160, an outer silicone rubber roller layer 166 is provided to define the operable roller outer surface 168 which engages the web upon movement of the first lamination roller 55 into its first or second lamination positions.

As mentioned above, the first lamination roller 55 is heated via an axial heating element 162. The roller 55 is rotated while in its non-laminating position (see FIG. 9) so that the heat passes evenly radially outwardly from the axial heating element 162. Without rotation, convection would make the outer roller surface 168 on the upper portion of the roller 55 warmer than on the lower portion thereof. As seen in FIG. 1, a gear 170 is affixed to an outer end of the first lamination roller 55. The teeth of the gear 170 are engaged by a drive gear 172 which in turn is driven by a motor 174 mounted to the frame 28 of the image transfer system 20. The motor 174 constantly drives the drive gear 172 when the image transfer system 20 is in operation. The cooperating teeth of the gears 170 and 172 are such that when the first lamination roller 55 is placed in its non-laminating position of FIG. 1, the gear 170 is driven to rotate the first roller 55. When the first roller 55 is moved to its first or second lamination position, however, the gear teeth disengage and the roller is not rotated or driven, other than through the pressure tracking forces exerted on the roller 55 through the web 32 from the drum 25 or second lamination roller 88. The gear teeth cooperate so that upon return of the roller 55 to its non-laminating position, it is again rotated in order to avoid convection unevenness on the outer roller surface 168 thereof.

Figure 10:
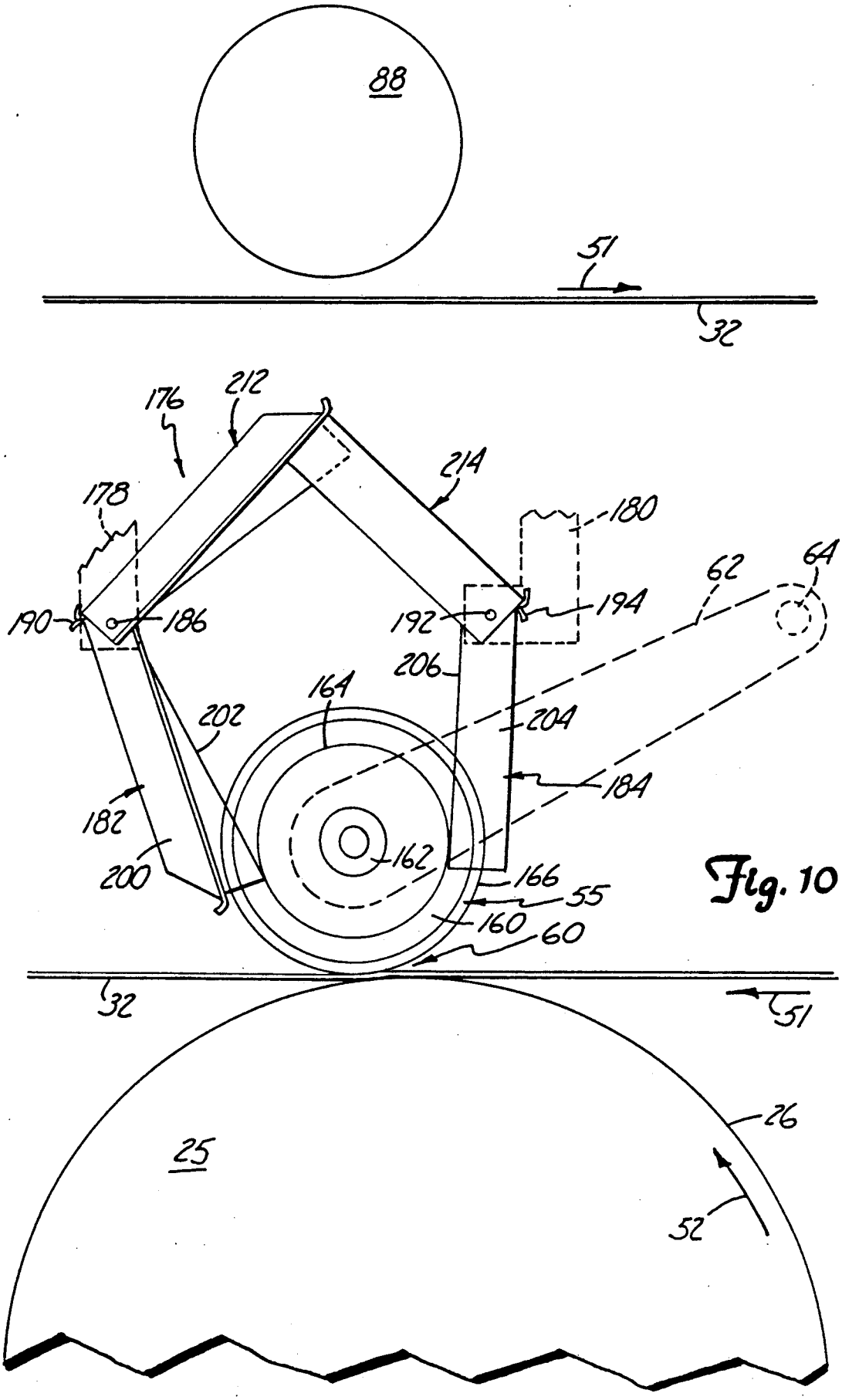

The temperature to which the roller 55 is heated depends upon the nature of the web and adhesive structure to be thermally activated. In order to further retain the heat within the roller 55 and maintain it at the desired temperature for lamination, a thermal insulating compartment 176 extends laterally about the first lamination roller 55 from end to end. The compartment is supported from the frame 28 by one or more support mounts, such as mounts 170 and 180, as seen in FIGS. 9–11.

The bottom portion of insulating compartment 176 is formed from first and second lateral panel sections 182 and 184. The first panel section 182 is pivotally mounted along a lateral pin 186 supported by the mount A spring 190 mounted about the pin 186 urges the first panel section 182 toward a closed position about the first lamination roller 55. The second panel section 184 is likewise supported by a lateral pin 192, and biased toward the first lamination roller 55 by a spring 194 about the pin 192.

Each of the panel sections 182 and 184 has a laterally extending wall, with end walls at each end of the lateral wall. The lateral wall structure is illustrated in the broken away section of the FIG. 9 on the first panel section 182 as wall 196, and a layer of thermal insulation material 198 is affixed to an inner side of the wall 196 The first panel section 182 has an end wall 200 joined to its lateral wall 196 which extends generally inwardly therefrom as seen in FIG. 9. The end wall 200 of the first panel section 182 has an inner ramp edge 202 which extends further and further away from the lateral wall 196 as it is spaced further from the pivot pin 186. The ramped edge 202 is aligned to engage the circumference of the hub portion 164 on the end of the first lamination roller 55 when the roller 55 is moved between its first lamination position (FIG. 10) and its non-laminating position (FIG. 9).

The second panel section 184 also has a lateral wall and insulating structure, like that illustrated for the first panel section 182. The second panel section 184 also has an end wall 204, but the structure of its end wall differs from that of the end wall 200 of the first panel section 182. The end wall 204 of the second panel section 184 is deeper and has an inner edge 206 which is preferably not ramped but rather extends parallel to the lateral wall of the second panel section 184. Thus, as the first lamination roller 55 moves from its unlaminated position (FIG. 9) to its first lamination position (FIG. 10) the circumference of the hub 164 engages the edges 202 and 204 of the first and second panel sections 182 and 184, respectively. This forces the panel sections to pivot partially out of the way about their respective pivot pins 86 and 192 and thereby permit the roller 55 to be moved adjacent to drum 25 to create the nip 60. In so doing, the bias forces of the springs 190 and 194 are overcome. The springs continue to urge the panel sections 182 and 184 against the circumference of the hub 164 during use, however, as seen in FIG. 10.

The design of the respective edges 202 and 204 of the panel sections 182 and 184, in combination with the circumference of the hub 164, causes the first panel section 182 to be engaged by the hub 164 before the second panel section 184 is engaged. As the first panel section 182 is pivoted away from the free end of the second panel section 184, the second panel section 184 is then engaged by the hub 164 of the moving first lamination roller 55 and both first and second panel sections 182 and 184 are then pivoted apart to their open position as seen in FIG. 10. This sequence of panel section movement is reversed when the first lamination roller 55 is moved from its first lamination position back to its non-lamination position, with the second panel section 184 placed in its "home position" (FIG. 9) before the first panel section 182, so that the free end of the first panel section 182 thereby extends over the free end of the second panel section 184 to complete the creation of a lower enclosure area for the insulating compartment 176, as seen in FIG. 9.

The insulating compartment 176 also has third and fourth lateral panel sections 212 and 214. The structure and operation of the third and fourth panel sections 212 and 214 is generally identical to that of the first and second panel sections 182 and 184. The third panel section 212 corresponds to the first panel section 182, and the fourth panel section 214 corresponds to the second panel section 184. The third panel section 212 is pivotally mounted about pivot pin 196 and biased against the first lamination roller 55 by the spring 190. The third lamination section 212 has a laterally extending wall with end walls such as end wall 216 which includes an inner ramped edge 218 (like ramped edge 202 of the first panel section 182) aligned for engagement with the circumference of the hub 164 when the roller 55 is moved toward and into its second lamination position (see FIG. 11). The fourth panel section 214 also has a laterally extending wall with end walls such as end wall 220 which has an inner edge 222 which is generally parallel to its lateral wall. Both the third and fourth panel sections 212 and 214 include insulating material 198 on inner surfaces thereof. The fourth panel section 214 is also pivotally mounted about pivot pin 192 and biased against the roller 55 by spring 194.

As the first lamination roller 55 is moved from its non-lamination position (FIG. 9) to its second lamination position (FIG. 11), the hub 164 engages the edges 218 and 222 to pivot the third and fourth wall sections 212 and 214, respectively, about their pivot pins and partially away from one another to permit the roller 55 to move into position adjacent to the second lamination roller 88 and define the nip 95. The bias of springs 190 and 194 urge the third and fourth panel sections 212 and 214 against the hub 164, but do not impede movement of the first lamination roller 55 to its second lamination position. The operating design of the edge portions 218 and 222, along with the hub 164, permit the third panel section 212 to be first engaged as the roller 55 moves upwardly towards its second lamination position and moved off of the free end of the fourth panel section 214 prior to engagement and movement of the fourth panel section 214 itself.

This sequence of events is reversed when the first lamination roller 5 is moved from its second lamination position back to its non-lamination position. The fourth panel section 214 is first placed in its "home" position and then the third panel section 212 pivots over the fourth panel section 214 to complete the upper enclosure portion of the insulating compartment 176. When all of the panel sections are in their "home" positions (FIG. 9), the hub 164 is not in contact with any of the edge portions of the respective panel sections, while the roller 55 is driven to rotate when in its non-lamination position as seen in FIGS. 1 and 9. Referring back to FIGS. 2–8, which depict the sequence of operation of the image transfer system 20, the relative movement of the panel sections of the insulating compartment 176 can be seen as the first lamination roller 55 is moved.

Figure 12:
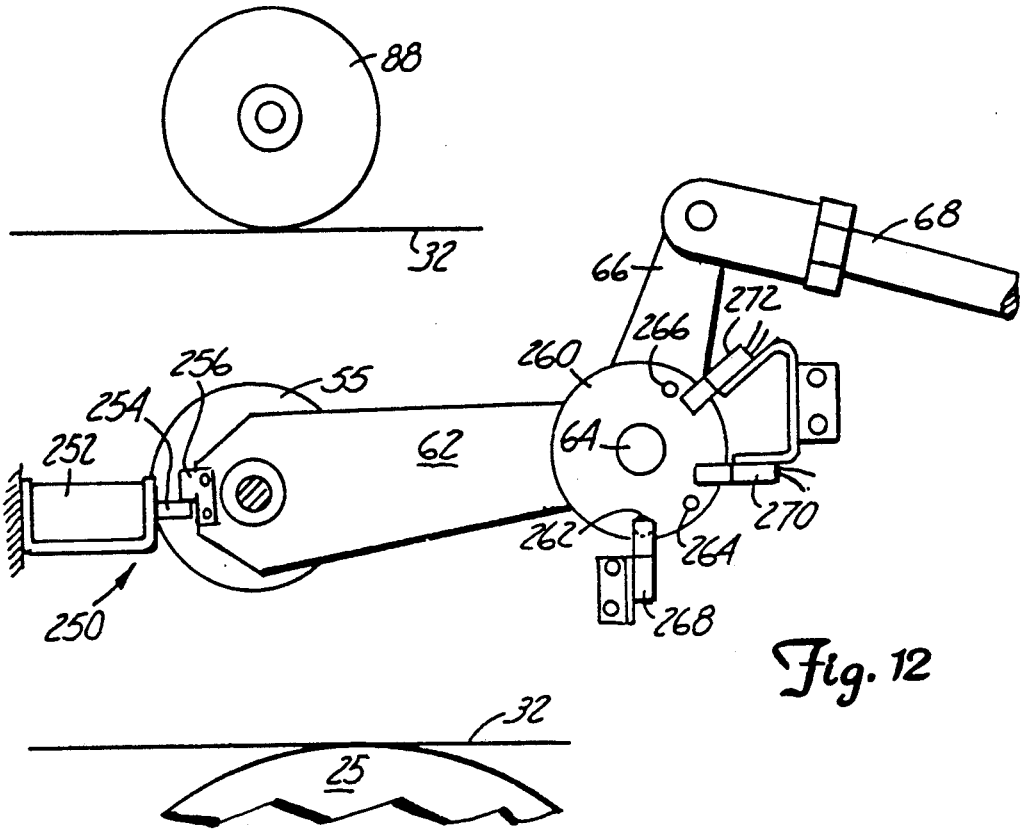
Figure 13:
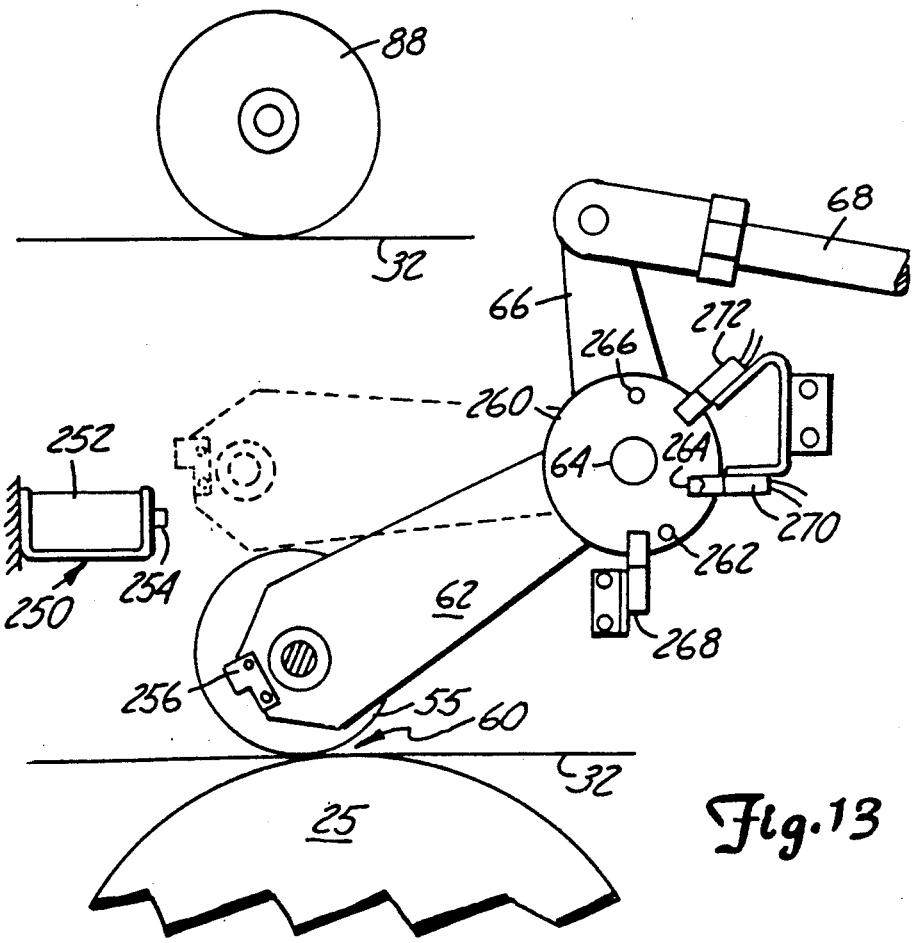

The arrangement for moving the first lamination roller 55 is further shown in FIGS. 12–13, with the insulating compartment removed for clarity. The non-lamination position of the roller 55 is defined by a lock pin arrangement 250. A solenoid 252 is mounted to the frame 28 and has a retractable latch pin 254. When the solenoid 252 is deenergized, the pin 254 is biased into an extended position, as seen in FIG. 12. A pin catch plate 256 is mounted at the free end of the support arm 62 and aligned so that when the pin 254 is extended, the catch plate engages the pin to support the arm 62 and roller 55 rotatably mounted thereon in its non-lamination intermediate position, as seen in FIG. 12.

To permit movement of the first lamination roller 55 to its first laminating position, the solenoid 252 is energized to retract the pin 254 and the actuator 70 is activated to pivot the support arm 62 counterclockwise about its pivot point 64. To move the roller 55 to its second laminating position, the pin 254 is left in place, and the actuator 70 is simply activated to pivot the support arm 62 and roller 55 rotatably mounted thereon in a clockwise manner about pivot pin 64. The operation of the solenoid 252 and actuator 70 are controlled by the microprocessor controller in combination with a sensing system mounted on the pivot end of the support arm 62. The sensing system includes a plate 260 with three sensor apertures 262, 264 and 266 therein. Three photoelectric sensors 268, 270 and 272 are mounted to the frame 28 about the plate 260, and each of them is aligned to detect the presence or absence of a particular aperture on the plate 260.

When the first lamination roller 55 is in its nonlamination position, the first aperture 262 is positioned across the first sensor 268. The latch pin 254 is extended and the ram 268 of the actuator 70 is partially extended. To move the first lamination roller 55 to its first laminating position, the solenoid 252 is energized to retract the latch pin 254, and the actuator 70 is activated to extend its ram 68 from its cylinder 72. This pivots the support arm 62 and plate 260 about pivot point 64 and the first lamination roller 55 moves downwardly. The first aperture 262 moves out of alignment with the first sensor 268, but when the roller 55 is positioned adjacent the drum 25, the second aperture 264 is in alignment with the second senor 270. This causes a signal to be generated to stop the actuator 70 from further extension of its ram 68.

Once the image transfer lamination step has been completed and the image is on the web 32, the actuator 70 is again activated to retract its ram 68 and move the first lamination roller 55 to its non-lamination position. The support arm 62 and roller 55 thereon are pivoted upwardly past the non-lamination position (as shown in phantom in FIG. 13) to provide enough clearance to allow the solenoid 252 to be deenergized to extend its latch pin 254. As the plate 260 follows the movement of the support arm 62 in this manner, the second aperture 264 is moved out of alignment with the second sensor 270, and the first aperture 262 is moved to and past the first sensor 268. The first sensor 268 detects the presence and then absence of the first aperture 262 to generate a signal to deenergize the solenoid 252 and allow the latch pin 254 to be extended. The actuator 70 is also deactivated to allow the first lamination roller 55 to settle back down by gravity until its catch plate 256 engages the latch pin 254. This then realigns the first aperture 262 with the first sensor 268, in its original position as seen in FIG. 12.

To move the first lamination roller 55 to its second lamination position, the actuator 70 is activated to retract its ram 68 and thereby pivot the support arm 62 and roller 55 thereon clockwise about pivot point 64. The plate 260 follows this pivoting movement as seen in FIG. 14. The first aperture 262 is moved out of alignment with the first sensor 268, and when the roller 55 is in its second laminating position, the third aperture 266 is placed into alignment with the third sensor 272. This causes a signal to be generated to stop the actuator 70 from further retraction of its ram 68 and thereby maintain the roller 55 in its second lamination position. Once the step of laminating the substrate 80 to the web 32 is completed, the actuator 70 is reactivated to extend its ram 68 and thereby pivot the support arm 62 and roller 55 thereon back to the non-lamination position. Alternatively, the actuator 70 may be simply deactivated to allow gravity to drop the first lamination roller 55 back to its non-lamination position wherein the catch plate 256 engages the latch pin 254. Although not shown in FIGS. 2–14, the thermal insulating compartment 176 works during movement of the first lamination roller 55 as seen in FIGS. 9–11.

Conclusion

The image transfer system of the present invention provides an efficient and automated system for taking a liquid toner image from an electrostatic carrier and creating a printed product therefrom. The use of a reel-to-reel web transfer system replaces the single sheet transfer systems of the prior art, and subsequently simplifies the transfer process. The sequential use of the adhesive on the web by controlled lamination creates effective and clean fracture points for separating the substrate (with the image embedded in an adhesive layer between the substrate and web) from the web and for creating subsequent lateral edges for the adhesive remaining on the web. The use of a dual purpose lamination roller simplifies the operation and enhances the efficiency, effectiveness and compact nature of the entire image transfer system of the present invention.

Although the present invention has been described with reference to preferred embodiments, workers skilled in the art will recognize that changes may be made in form and detail without departing from the spirit and scope of the invention.

What is claimed is:

1. A method of image transfer in an electrographic copying process comprises the steps of:

rotating a drum, which has an electrostatic outer surface bearing a toned image thereon, about its axis;

providing a first lamination roller along an axis parallel to the axis of the drum and adjacent the drum to define a first nip therebetween;

advancing an image transfer web having an adhesive layer on one side thereof through the first nip to force the adhesive layer against the outer surface of the drum and thereby embed the image in the adhesive layer and transfer the image from the drum to the web as the web is advanced past the rotating drum;

aligning an image substrate in a desired registry with the image borne by the adhesive layer on the web;

advancing the substrate and web through a second nip defined by a pair of lamination rollers to force the substrate against the adhesive layer on the web and thereby adhere the substrate to the adhesive layer and embedded image on the web; and separating the web from the adhesive layer and substrate, with the image embedded in the adhesive layer now borne by the substrate.

2. The method of claim 1, and further comprising the step of:

moving the first lamination roller between a first position adjacent the drum wherein the first nip is defined by the first lamination roller and the drum and a second position adjacent a second lamination roller wherein the two lamination rollers together define the second nip.

3. The method of claim 2, and further comprising the step of:

aligning the first lamination roller in a intermediate third position spaced from the drum and spaced from the second lamination roller.

4. The method of claim 3, and further comprising the steps of:

heating the first lamination roller; and rotating the first lamination roller when it is placed in its third position.

5. The method of claim 4, and further comprising the step of:

providing an insulating compartment around the heated first lamination roller when it is in its third position.

6. The method of claim 5, and further comprising the step of:

opening a portion of the compartment around the heated first lamination roller as it moves toward the drum to permit formation of the first nip therebetween.

7. The method of claim 5, and further comprising the step of:

opening a portion of the compartment around the heated first lamination roller as it moves toward the second lamination roller to permit formation of the second nip therebetween.

8. The method of claim 1, and further comprising the step of:

defining a path for movement of the image transfer web past the first and second nips between a web supply reel and a web take-up reel.

9. The method of claim 8, and further comprising the steps of:

moving the web along its path in a first direction toward the supply reel during the advancing and separation steps; and moving the web along its path in a second, opposite direction toward the take-up reel after the separation step to align the web and adhesive layer thereon for the transfer of another image from the drum.

10. The method of claim 9 wherein the adhesive layer is incrementally used up from the web for each successive image transferred as the web is wound onto its take-up reel.

11. The method of claim 1, and further comprising the step of:

defining the image transfer web as a polyester film.

12. The method of claim 1, and further comprising the step of:

advancing the image-bearing substrate through a third nip defined by a pair of deglossing rollers at a desired speed, temperature and pressure to impart a predetermined surface finish to the image-bearing side of the substrate.

13. The method of claim 1 wherein the aligning step further includes the step of:

preloading a leading edge portion of the substrate through the second nip so that the leading edge portion of the substrate is not adhered to the web during the second advancing step.

14. The method of claim 13, wherein the separating step further includes the steps of:

guiding the unadhered leading edge portion of the substrate away from the web; and abruptly changing the direction of travel of the web to facilitate separation of the adhesive layer therefrom.

15. The method of claim 1, and further comprising the step of:

cooling the adhered web and substrate prior to the separating step.

16. A method of image transfer in an electrographic copying process comprises the steps of:

providing an image transfer web which has, on one side thereof, a first leading section bearing an adhesive layer thereon and a second trailing section bearing no adhesive, the sections being separated along a generally lateral separation line and the first section having a first segment of the adhesive layer which has a leading edge longitudinally spaced from the separation line, and a trailing edge defining the generally lateral separation line between the first and second sections of the web;

advancing the web longitudinally in a first direction along a path to a position whereby the leading edge of the first segment is aligned with a lead end of an image to be transferred to the web;

laminating the image and the first segment of the first leading section of the web together to embed the image in the adhesive layer on the first segment as the web is advanced along the path;

laminating a substrate to the first segment of the first section of the web to bond the substrate and adhesive layer together as the web is advanced along the path;

separating the substrate, first segment of the adhesive layer and image embedded therein from the web as the web is advanced along the path, whereby the separation of the leading edge of the first segment from the web defines a trailing edge of a second segment of the adhesive layer on the first leading section of the web with the newly defined trailing edge of the second segment in turn defining a new generally lateral separation line between the first and second sections of the web; and moving the web in a second, opposite direction along the path to a position whereby a leading edge of the second segment, which is longitudinally spaced from the trailing edge thereof, is aligned with a lead end of a second image to be transferred to the web.

17. The method of claim 16, and further comprising the step of:

failing to laminate a leading edge portion of the substrate to the web;

guiding the unlaminated leading edge portion of the substrate away from the web to initiate the separating step; and abruptly changing the direction of the path of the web during the separating step whereby the leading edge of the first segment of the adhesive layer separates from the web along a generally lateral line across the web, thereby defining the new separation line between the first and second sections of the web.

18. The method of claim 16, and further comprising the step of:

cooling the laminated web and substrate prior to separation thereof.

19. The method of claim 16, and further comprising the step of:

moving the image-bearing substrate through a pair of deglossing rollers at a desired speed, temperature and pressure to impart a predetermined surface finish to the image-bearing side of the substrate.

20. The method of claim 16 wherein the web is moved along the path in the second direction from a web supply reel to a web take-up reel.

21. The method of claim 16, and further comprising the step of:

applying back tension to the web as it is advanced along the path.

22. The method of claim 16, and further comprising the steps of:

providing a heated lamination roller; and using the lamination roller in both lamination steps.

23. The method of claim 22, and further comprising the steps of:

moving the lamination roller to a first lamination position opposed from an electrostatic surface carrier for the image for the first laminating step; and moving the lamination roller to a second lamination position opposed from another lamination surface for the second laminating step.

24. The method of claim 23, and further comprising the step of:

moving the lamination roller to a third position between its first and second lamination positions wherein the lamination roller is spaced from the web.

25. The method of claim 24, and further comprising the step of:

providing an insulating compartment around the heated lamination roller.

26. The method of claim 25, and further comprising the steps of:

opening a portion of the compartment around the heated lamination roller as it moves toward its first position; and opening another portion of the compartment around the heated lamination roller as it moves towards its second position.

27. The method of claim 16 wherein prior to laminating the substrate to the web the method further comprises the step of:

evaluating the quality of the image that has been transferred to the web as the web is advanced along the path.

28. The method of claim 16 wherein the rate of web advance along the path is higher during the step of laminating the substrate to the web than during the step of laminating the image to the web.

29. The method of claim 16, and further comprising the step of:

tracking the extent of movement of the web along the path so that the position of the lateral separation line on the web is known for web alignment purposes.

30. An electrographic copying apparatus for transferring a toned image from an electrostatic carrier to a substrate, the apparatus comprising:

an image transfer web;

means for moving the web along a path past the electrostatic carrier;

a first lamination roller movable between first and second lamination positions wherein the roller is positioned adjacent the electrostatic carrier in the first lamination position whereby pressure is applied by the roller against the electrostatic carrier to laminate the image to the web as the web is moved along the path past the carrier, wherein the roller is spaced from the carrier in the second lamination position;

a second lamination roller spaced from the electrostatic carrier and along the path so that when the first lamination roller is moved to its second lamination position the first and second lamination rollers form a nip across the path for laminating the substrate to the image-bearing web as the web is advanced along the path; and means for separating the substrate and image from the web.

31. The apparatus of claim 30 wherein the first lamination roller is movable to a third position between its first and second lamination positions where the first lamination roller is spaced from both the electrostatic carrier and the second lamination roller.

32. The apparatus of claim 31 wherein the first lamination roller is heated, and wherein the apparatus further comprises:

a thermal insulating compartment around the lamination roller.

33. The apparatus of claim 32 wherein the first lamination roller extends laterally across the path of the web and wherein the insulating compartment completely envelopes the first lamination roller across its lateral extent when the first lamination roller is in its third position.

34. The apparatus of claim 32 wherein the insulating compartment has first and second lateral panel sections which open as the first lamination roller is moved toward its first lamination position.

35. The apparatus of claim 34 wherein the first and second panel sections are biased into a closed position.

36. The apparatus of claim 34, and further comprising:

opposed means on the first lamination roller and the first and second panel sections for sequentially opening and closing the panel sections as the first lamination roller moves between its first and third positions.

37. The apparatus of claim 32 wherein the insulating compartment has third and fourth lateral panel sections which open as the first lamination roller is moved toward its second lamination position.

38. The apparatus of claim 34 wherein the third and fourth panel sections are biased into a closed position.

39. The apparatus of claim 34, and further comprising:

opposed cam surface means on the first lamination roller and the panel sections for sequentially opening and closing the panel sections as the first lamination roller moves between its second and third positions.

40. The apparatus of claim 32, and further comprising:

means for rotating the first lamination roller when it is in its third position.

* * * * *

UNITED STATES PATENT AND TRADEMARK OFFICE

CERTIFICATE OF CORRECTION

PATENT NO. : 5,023,668

DATED : June 11, 1991

INVENTOR(S) : Dennis J. Kluy, Gregory L. Zwadlo, John L. Marty, William V. Dower It is certified that error appears in the above-identified patent and that said Letters Patent is hereby corrected as shown below: On the Title page, item [75], "Dennis J. Kluy, Stillwater; Gregory L. Zwadlo, Ellsworth; John L. Marty, White Bear Lake; William V. Dower, St. Paul, all of Minn." should read --Dennis J. Kluy, Stillwater, Minn.; Gregory L. Zwadlo, Ellsworth, Wisc.; John L. Marty, White Bear Lake, Minn.; William V. Dower, St. Paul, Minn.--

Col. 6, line 64, "roller" should read --rollers--.

Col. 7, lines 35-36, ""deglossed"60" should read --"deglossed"--.

Col. 9, line 8, "FIG..3" should read --FIG. 3--.

Col. 10, line 31, "3" should read --32--.

Col. 10, line 32, "adhesiVe" should read --adhesive--.

Col. 11, line 31, "proCessing" should read --processing--.

Col. 13, line 4, after "196" insert --.--.

UNITED STATES PATENT AND TRADEMARK OFFICE

CERTIFICATE OF CORRECTION

PATENT NO. : 5,023,668

DATED : June 11, 1991

INVENTOR(S) : Dennis J. Kluy, et. al.

It is certified that error appears in the above-indentified patent and that said Letters Patent is hereby corrected as shown below:

Col. 14, line 32, "5" should read --55--.

Signed and Sealed this

Fifteenth Day of June, 1993

*Attest:*

Michael K. Kirk

MICHAEL K. KIRK

*Attesting Officer*

*Acting Commissioner of Patents and Trademarks*